US012140359B2

(12) United States Patent
Welch et al.

(10) Patent No.: US 12,140,359 B2
(45) Date of Patent: Nov. 12, 2024

(54) CLIMATE CONTROL SYSTEMS FOR USE WITH HIGH GLIDE WORKING FLUIDS AND METHODS FOR OPERATION THEREOF

(71) Applicant: Copeland LP, Sidney, OH (US)

(72) Inventors: Andrew M. Welch, Sidney, OH (US); William Bradford Boggess, Lebanon, OH (US); Rajan Rajendran, Sidney, OH (US)

(73) Assignee: Copeland LP, Sidney, OH (US)

( * ) Notice: Subject to any disclaimer, the term of this patent is extended or adjusted under 35 U.S.C. 154(b) by 100 days.

(21) Appl. No.: 17/507,403

(22) Filed: Oct. 21, 2021

(65) Prior Publication Data

US 2023/0130167 A1 Apr. 27, 2023

(51) Int. Cl.
*F25B 49/02* (2006.01)
*F25B 9/00* (2006.01)
(Continued)

(52) U.S. Cl.
CPC ..... *F25B 9/006* (2013.01); *F25B 49/02* (2013.01); *F25B 13/00* (2013.01); *F25B 41/40* (2021.01)

(58) Field of Classification Search
CPC ..... F25B 9/006; F25B 43/00; F25B 43/006; F25B 43/02; F25B 2400/23;
(Continued)

(56) References Cited

U.S. PATENT DOCUMENTS 4,068,494 A * 1/1978 Kramer ..... F25B 41/00 62/509
4,249,389 A 2/1981 Mayer
(Continued)

FOREIGN PATENT DOCUMENTS

CA 2127134 A1 12/1995
EP 2054677 A1 5/2009
(Continued)

OTHER PUBLICATIONS

WO-2019187231-A1 English Translation (Year: 2019).*
(Continued)

*Primary Examiner* — David J Teitelbaum
*Assistant Examiner* — Devon Moore
(74) *Attorney, Agent, or Firm* — Harness, Dickey & Pierce, P.L.C.

(57) ABSTRACT

Climate control systems and methods of operating them are provided that circulate a working fluid including a high glide refrigerant blend having first and second refrigerants with a difference in boiling points ≥about 25° F. at atmospheric pressure. The system includes a gas-liquid separation vessel that generates a vapor stream and a liquid stream. A compressor receives the vapor stream and generates a pressurized vapor stream. A liquid pump receives the liquid stream and generates a pressurized liquid stream. A condenser is disposed downstream of the compressor and liquid pump and receives and cools the pressurized mixed vapor and liquid stream. An evaporator receives and at least partially vaporizes the multiphase working fluid and directs it to the gas-liquid separating vessel. An expansion device between the condenser and the evaporator processes the multiphase working fluid stream. Lastly, a fluid conduit for circulating the working fluid through the components is provided.

21 Claims, 6 Drawing Sheets

(51) Int. Cl.
*F25B 13/00* (2006.01)
*F25B 41/40* (2021.01)

(58) Field of Classification Search
CPC ..... F25B 2400/16; F25B 2400/0403; F25B 2400/17; F25B 2400/053; F25B 31/004
See application file for complete search history.

(56) References Cited

U.S. PATENT DOCUMENTS

| | | | | |
|---|---|---|---|---|
| 4,303,090 | A | 12/1981 | Mayer | |
| 4,702,086 | A | 10/1987 | Nunn, Sr. et al. | |
| 4,787,211 | A | 11/1988 | Shaw | |
| 4,788,352 | A | 11/1988 | Smutny | |
| 5,056,329 | A | 10/1991 | Wilkinson | |
| 5,230,223 | A | 7/1993 | Hullar et al. | |
| 5,848,537 | A * | 12/1998 | Biancardi | F25B 13/00 62/324.6 |
| 5,996,358 | A | 12/1999 | Sumida et al. | |
| 6,058,727 | A | 5/2000 | Fraser, Jr. et al. | |
| 6,672,102 | B1 * | 1/2004 | Huenniger | F25B 31/004 62/472 |
| 6,973,804 | B2 | 12/2005 | Horiuchi et al. | |
| 7,086,237 | B2 | 8/2006 | Arshansky et al. | |
| 7,832,222 | B2 | 11/2010 | McMasters | |
| 8,117,859 | B2 | 2/2012 | Chessel et al. | |
| 8,444,874 | B2 | 5/2013 | Singh et al. | |
| 8,522,564 | B2 | 9/2013 | Koppineedi et al. | |
| 8,534,080 | B2 | 9/2013 | Perti | |
| 8,572,992 | B2 | 11/2013 | Murray et al. | |
| 8,671,703 | B2 | 3/2014 | Mitra et al. | |
| 8,925,337 | B2 | 1/2015 | Poux et al. | |
| 9,243,820 | B2 | 1/2016 | Park et al. | |
| 9,541,311 | B2 | 1/2017 | Hinde et al. | |
| 9,689,590 | B2 | 6/2017 | Christensen | |
| 9,885,503 | B2 | 2/2018 | Kopko | |
| 10,156,389 | B2 | 12/2018 | Ishiyama et al. | |
| 10,288,306 | B2 | 5/2019 | Ridder et al. | |
| 10,400,149 | B2 | 9/2019 | Schultz et al. | |
| 10,473,369 | B2 | 11/2019 | Talhouarn | |
| 10,655,040 | B2 | 5/2020 | Close et al. | |
| 10,697,683 | B2 | 6/2020 | Sun et al. | |
| 10,739,045 | B2 | 8/2020 | Kopko | |
| 10,907,863 | B2 | 2/2021 | Sethi et al. | |
| 10,976,078 | B2 | 4/2021 | Kniffler et al. | |
| 11,131,471 | B1 | 9/2021 | Butler et al. | |
| 11,137,172 | B2 | 10/2021 | Kniffler et al. | |
| 11,175,076 | B2 | 11/2021 | Kopko et al. | |
| 11,199,356 | B2 | 12/2021 | Kopko et al. | |
| 11,320,181 | B2 | 5/2022 | Gentry | |
| 11,359,847 | B2 | 6/2022 | Kopko et al. | |
| 11,466,907 | B2 | 10/2022 | Bandhauer et al. | |
| 11,506,406 | B2 | 11/2022 | Grabon | |
| 11,555,635 | B2 | 1/2023 | Zhang et al. | |
| 11,754,324 | B2 | 9/2023 | Welch et al. | |
| 2001/0009360 | A1 | 7/2001 | Jin | |
| 2003/0068181 | A1 | 4/2003 | Miyata et al. | |
| 2003/0131541 | A1 | 7/2003 | Lee et al. | |
| 2004/0008530 | A1 | 1/2004 | Kitahata et al. | |
| 2004/0025525 | A1 | 2/2004 | Kubo et al. | |
| 2004/0187504 | A1 | 9/2004 | Healy et al. | |
| 2005/0031322 | A1 | 2/2005 | Boyle et al. | |
| 2005/0062448 | A1 | 3/2005 | Oh et al. | |
| 2005/0120733 | A1 | 6/2005 | Healy et al. | |
| 2005/0223722 | A1 | 10/2005 | Yamashita et al. | |
| 2005/0258793 | A1 | 11/2005 | Chin et al. | |
| 2006/0033457 | A1 | 2/2006 | Won et al. | |
| 2010/0036530 | A1 | 2/2010 | Chessel et al. | |
| 2010/0036531 | A1 | 2/2010 | Chessel et al. | |
| 2016/0271542 | A1 | 9/2016 | Huff et al. | |
| 2017/0314825 | A1 * | 11/2017 | Scancarello | F25B 49/043 |
| 2018/0209701 | A1 | 7/2018 | Perrotin | |
| 2019/0128569 | A1 | 5/2019 | Tada et al. | |
| 2020/0354618 | A1 | 11/2020 | Minor et al. | |
| 2021/0123637 | A1 | 4/2021 | Petersen et al. | |
| 2021/0396436 | A1 | 12/2021 | Hartfield et al. | |
| 2022/0373235 | A1 | 11/2022 | Catano-Montoya | |
| 2023/0080007 | A1 | 3/2023 | Kopko | |
| 2023/0086299 | A1 | 3/2023 | Arya et al. | |
| 2023/0130167 | A1 | 4/2023 | Welch et al. | |

FOREIGN PATENT DOCUMENTS

| | | | | |
|---|---|---|---|---|
| EP | 3462108 | A1 | 4/2019 | |
| EP | 3658829 | A1 | 6/2020 | |
| GB | 2508614 | A | 6/2014 | |
| WO | WO-2008042358 | A1 | 4/2008 | |
| WO | WO-2008118703 | A1 * | 10/2008 | F25B 9/006 |
| WO | WO-2009053726 | A2 | 4/2009 | |
| WO | WO-2015125534 | A1 * | 8/2015 | C07C 21/18 |
| WO | WO-2019023267 | A1 | 1/2019 | |
| WO | WO-2019187231 | A1 * | 10/2019 | C09K 5/041 |
| WO | WO-2020003965 | A1 * | 1/2020 | B60H 1/00278 |
| WO | WO-2022066663 | A1 | 3/2022 | |

OTHER PUBLICATIONS

WO-2020003965-A1 English Translation (Year: 2020).*
WO-2015125534-A1 English Translation (Year: 2015).*
Refrigerants—Physical Properties (NPL-1) (Year: 2006).*
ASHRAE: Designation and Safety Classification of Refrigerants (NPL-2) (Year: 2019).*
Andrew M. Welch et al., U.S. Appl. No. 17/019,946, filed Sep. 14, 2020, entitled Refrigerant Isolation Using a Reversing Valve, 92 pages.
Kurt W. Roth et al., Energy Consumption Characteristics of Commercial Building HVAC Systems vol. III: Energy Savings PotentialEnergy Consumption Characteristics of Commercial Building HVAC Systems vol. III: Energy Savings Potential, Jul. 2002, 281 pages.
Toshiba, Perfect Comfort catalog, Daiseikai Air Conditioner, www.toshibaaircon.ru, Aug. 15, 2005, 36 pages.
Valery Krasnoslobodtsev et al., TRIZ Improvement of Rotary Compressor Design, Apr. 2005, 15 pages.
6.5 Co-versus Counter-Current Flow; SWEP; https://www.swep.net/refrigerant-handbook/6.-evaporators/asas6/; website accessed Oct. 21, 2021; 4 pages.
King Xu, Investigation of Vapor Injection Heat Pump System with a Flask Tank Utilizing R410A and Low-GWP Refrigerant R32; Nov. 3, 2012; 265 pages.
Frank B. Biancardi et al.; Investigation into the Fractionation of Refrigerant Blends; Jan. 1996; 232 pages.
2010 ASHRAE Handbook; HVAC Systems and Equipment; Chapter 37 Solar Energy Equipment and Systems; https://handbook.ashrae.org/Print.html?file=https://handbook.ashrae.org/Handbooks/S20/IP/S20_Ch37/S20_ch37_ip.aspx; downloaded Dec. 1, 2021; 44 pages.
International Search Report and Written Opinion for PCT Application No. US2022/046173 issued Feb. 3, 2023; 6 pages.
Larrondo-Sancho, R. et al.; "Experimental Evaluation of the Novel R744/R1270 Blend in a Transcritical Refrigeration Plant," ICR2023, 26th International Congress of Refrigeration; Aug. 21-25, 2023; 10 pages.
Sicco, Emanuele et al.; "Experimental Evaluation of Different Refrigeration System Configurations Using $CO_2$-Based Blends as Refrigerants," ICR2023, International Congress of Refrigeration; Aug. 21-25, 2023; 11 pages.

* cited by examiner

A

B

CLIMATE CONTROL SYSTEMS FOR USE WITH HIGH GLIDE WORKING FLUIDS AND METHODS FOR OPERATION THEREOF

FIELD

The present disclosure relates to climate control systems for use with working fluids having refrigerant blends exhibiting high glide and methods for operating the same.

BACKGROUND

This section provides background information related to the present disclosure which is not necessarily prior art.

A conventional thermodynamic climate control system such as, for example, a heat-pump system, a refrigeration system, or an air conditioning system, may include a fluid circuit having a first heat exchanger (e.g., a condenser that facilitates a phase change of refrigerant from gas/vapor phase to a liquid) that is typically located outdoors, a second heat exchanger (e.g., evaporator that facilitates a phase change of refrigerant from liquid to gas/vapor phase) that is typically located indoors or within the environment to be cooled, an expansion device disposed between the first and second heat exchangers, and a compressor that operates via a vapor compression cycle (VCC) to circulate and pressurize a gas/vapor phase refrigerant (and optional lubricant oil) between the first and second heat exchangers (e.g., condenser and evaporator). The compressor is typically a mechanical compressor that serves to pressurize the refrigerant, which can be subsequently condensed and evaporated as it is circulated within the system to transfer heat into or out of the system.

In the United States, it is estimated that over 40% of primary energy consumption is attributed to buildings, including energy consumption for climate control (e.g., heating and cooling) in these buildings. Efficient and reliable operation of heating and cooling climate control systems can help to reduce energy consumption and potential greenhouse gas emissions associated with use and leakage of certain refrigerants.

Refrigeration and air conditioning applications are under increased regulatory pressure to reduce the global warming potential of the refrigerants they use. In order to use lower global warming potential refrigerants, the flammability of the refrigerants may increase.

Several refrigerants have been developed that are considered low global warming potential options, and they have an ASHRAE (American Society of Heating, Refrigerating and Air-Conditioning Engineers) classification as A2L (mildly flammable/lower flammability than A2 and A3 refrigerants and lower toxicity) or A1 (no flame propagation/lower toxicity levels). Examples of A2L refrigerants include difluoromethane ($CH_2F_2$ or R-32—as used herein, the refrigerants may be interchangeably described by the conventional nomenclature of "R" for refrigerant or their specific chemical class code, like HFC-32) with a global warming potential of about 677, and hydrofluorolefins (HFOs), like 2,3,3,3-tetrafluoroprop-1-ene (HFO-1234yf or R-1234yf), trans-1,3,3,3-tetrafluoroprop-1-ene (HFO-1234ze or R-1234ze). A1 refrigerants include carbon dioxide ($CO_2$ or R-744), which has a desirably low global warming potential of 1,1-chloro-3,3,3-trifluoropropene (cis- and trans-HFO-1233zd(Z) or R-1233zd (Z) and HFO-1233zd(E) or R-1233zd (E)), chlorodifluoromethane (R-22 or $CHClF_2$), and R-410A that is a near-azeotropic mixture of difluoromethane (HFC-32) and pentafluoroethane (HFC-125).

In particular, the heating, ventilation, air conditioning, and refrigeration (HVAC/R) industry has been searching for A1 (non-toxic and non-flammable) refrigerants, including blends with such A1 refrigerants, that have high cooling capacity per displacement, while desirably avoiding supercritical operation and sub-atmospheric pressures in order to enable low-cost compression and piping, while protecting the safety of the equipment operators and users. Thus, it would be desirable to employ climate control systems that can successfully employ such environmentally friendly refrigerants with low Global Warming Potential.

SUMMARY

This section provides a general summary of the disclosure and is not a comprehensive disclosure of its full scope or all of its features.

In certain aspects, the present disclosure relates to climate control systems that circulate a working fluid comprising a refrigerant blend having high glide. In one variation, the climate control system comprises a working fluid comprising a first refrigerant and a second refrigerant. A difference in boiling points between the first refrigerant and the second refrigerant is greater than or equal to about 25° F. at atmospheric pressure. The climate control system also includes a gas-liquid separation vessel that receives the working fluid to separate it into a vapor stream and a liquid stream. The climate control system further comprises a compressor that receives the vapor stream from the gas-liquid separation vessel and generates a pressurized vapor stream. A liquid pump receives the liquid stream from the gas-liquid separation vessel and generates a pressurized liquid stream. The climate control system further includes a first heat exchanger disposed downstream of the compressor that receives and cools the pressurized vapor stream and receives the pressurized liquid stream from the gas-liquid separation vessel to generate a multiphase or liquid working fluid stream. The climate control system also comprises a second heat exchanger that receives the multiphase or liquid working fluid stream and at least partially vaporizes the multiphase or liquid working fluid that is directed to the gas-liquid separation vessel. The system also includes an expansion device disposed between the first heat exchanger and the second heat exchanger that processes the multiphase or liquid working fluid stream. Finally, a fluid conduit circulates the working fluid and establishes fluid communication between the second heat exchanger, the gas-liquid separation vessel, the compressor, the first heat exchanger, and the expansion device through which the working fluid circulates.

In one aspect, the climate control system further comprises a liquid-to-suction heat exchanger disposed downstream of the first heat exchanger and upstream of the second heat exchanger. The liquid-to-suction heat exchanger receives the multiphase or liquid working fluid stream from the first heat exchanger in a first flow direction and low-pressure multiphase working fluid stream from the second heat exchanger in a second flow direction to transfer heat therebetween.

In one aspect, the climate control system further comprise a check valve disposed between the second heat exchanger and the liquid-to-suction heat exchanger.

In one aspect, the climate control system further comprises an accumulator for storing a volume of the working fluid disposed downstream of the expansion device and upstream of the second heat exchanger.

In one aspect, the climate control system further comprises a storage vessel for the working fluid disposed in parallel in the fluid conduit to the first heat exchanger that is configured to selectively receive a portion of the pressurized vapor stream from the compressor and that is configured to be in selective fluid communication with the expansion device.

In one aspect, the gas-liquid separation vessel has a volume with an excess capacity and is configured to selectively store at least a portion of the working fluid.

In one aspect, the first refrigerant comprises an ASHRAE class A1 or A2L refrigerant.

In one aspect, the first refrigerant and the second refrigerant are independently selected from the group consisting of: carbon dioxide (R-744), chlorodifluoromethane (R-22), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3-tetrafluoroprop-1-ene (R-1234yf), cis- and trans-1,3,3,3-tetrafluoropropene (HFO-1234ye), cis- and trans-1,3,3,3-tetrafluoroprop-1-ene (R-1234ze), 3,3,3-trifluoropropene (HFO-1234zf), trifluoro,monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), and any isomers or combinations thereof.

In one aspect, the working fluid further comprises a lubricant that is preferentially soluble with the first refrigerant and the climate control system further comprises an oil storage vessel or sump that stores at least a portion of the lubricant in the working fluid.

In one aspect, the climate control system further comprises a reversing valve or a pair of four way valves to enable the system to conduct both heating and cooling.

In other aspects, the present disclosure relates to methods for operating a climate control system that circulates a working fluid comprising a refrigerant blend having high glide. In one variation, the method comprises pressurizing a working fluid vapor by passing it through a compressor in a fluid conduit and pressurizing a working fluid liquid by passing it through a pump. The method also comprises condensing at least a portion of the working fluid in a first heat exchanger disposed downstream of the compressor. The pressure of the working fluid is then reduced by passing it through an expansion device disposed downstream of the first heat exchanger. Next, at least a portion of the working fluid is evaporated in a second heat exchanger disposed downstream of the expansion valve and upstream of the compressor. The method also comprises passing the working fluid into a gas-liquid separation vessel disposed downstream of the second heat exchanger that separates the working fluid into a vapor stream that is directed to the compressor and a liquid stream that is directed to the first heat exchanger. The working fluid comprises the refrigerant blend having high glide that comprises a first refrigerant and a second refrigerant, where a difference in boiling points between the first refrigerant and the second refrigerant is greater than or equal to about 25° F. at atmospheric pressure.

In one aspect, the high glide refrigerant blend defines a full phase change for condensation and the condensing only partially condenses the working fluid to a liquid phase and permits only a portion of the full phase change to occur, so that after the condensing, the second refrigerant is predominantly liquid. Thus, a portion of the first refrigerant is liquid and a portion of the first refrigerant remains as vapor as it enters the expansion device and the second heat exchanger.

In one aspect, the high glide refrigerant blend defines a full phase change for evaporation and the evaporating only partially evaporates the working fluid to a vapor phase and permits only a portion of the full phase change to occur, so that after the evaporating, the first refrigerant is vapor, while a portion of the second refrigerant is vapor and a portion of the second refrigerant remains as liquid as it enters the gas-liquid separation vessel.

In one aspect, the condensing only partially condenses the working fluid to a liquid phase and the evaporating only partially evaporates the working fluid to a vapor phase, where: (i) the condensing is performed on a mixed stream formed by mixing the liquid stream pumped from the gas-liquid separation vessel and working fluid exiting the compressor that is pressurized and superheated to condense the mixed stream from a two-phase fluid to a two-phase fluid with relatively lower vapor quality; or (ii) the condensing is performed on a mixed stream formed by mixing the liquid stream pumped from the gas-liquid separation vessel and working fluid exiting the compressor that is pressurized and superheated to condense the mixed stream from a two-phase fluid to a saturated or subcooled liquid and the evaporating is performed on a fluid stream having a first vapor quality that is higher than a second vapor quality.

In one aspect, the fluid conduit further comprises at least one storage vessel and the method comprises further comprising storing a portion of the first refrigerant and/or the second refrigerant in the at least one storage vessel to modulate cooling capacity of the climate control system.

In one further aspect, the at least one storage vessel is disposed upstream of the second heat exchanger in the fluid conduit. Increasing an amount of the second refrigerant stored in the at least one storage vessel decreases a concentration of the second refrigerant in the working fluid circulating in the fluid conduit and increases cooling capacity of the climate control system; or decreasing an amount of the second refrigerant stored in the at least one storage vessel increases a concentration of the second refrigerant in the working fluid circulating in the fluid conduit and decreases cooling capacity of the climate control system.

In one aspect, the at least one storage vessel is disposed in the fluid conduit in parallel with the first heat exchanger. The method optionally includes increasing an amount of first refrigerant stored in the at least one storage vessel to decrease a concentration of the first refrigerant in the working fluid circulating in the fluid conduit and to decrease cooling capacity of the climate control system. Alternatively, the method optionally includes decreasing an amount of the first refrigerant stored in the at least one storage vessel to increase a concentration of the first refrigerant in the working fluid circulating in the fluid conduit and to increase cooling capacity of the climate control system.

In one aspect, a first temperature range of the refrigerant blend is operated to be greater than or equal to about 66% to less than or equal to about 150% of a second temperature range of air in the first heat exchanger or the second heat exchanger.

In one aspect, the fluid conduit further comprises a liquid-to-suction heat exchanger disposed downstream of the first heat exchanger and upstream of the second heat exchanger. The method further comprises passing the working fluid stream from the first heat exchanger through a first side of liquid-to-suction heat exchanger in a first flow direction and passing the low-pressure working fluid stream from the second heat exchanger in a second flow direction to transfer heat therebetween.

In one aspect, the first refrigerant and the second refrigerant are independently selected from the group consisting of: carbon dioxide (R-744), chlorodifluoromethane (R-22), 1,1,1,2-tetrafluoroethane (R134A), R410A (a near-azeotropic mixture of difluoromethane (R-32) and pentafluoroethane (R-125), dimethyl ether (R-E170), propane (R-290), 2,3,3,3-tetrafluoroprop-1-ene (R-1234yf), cis- and trans-1,3,3,3-tetrafluoropropene (HFO-1234 ye), cis- and trans-1,3,3,3-tetrafluoroprop-1-ene (R-1234ze), 3,3,3-trifluoropropene (HFO-1234zf), trifluoro,monochloropropenes (HFO-1233), trans-1-chloro-3,3,3-trifluoropropene (HFO-1233zd (E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132 (E)), and any isomers or combinations thereof.

In yet other aspects, the present disclosure relates to a method for operating a climate control system that circulates a working fluid comprising a refrigerant blend having high glide. The method comprises pressurizing a working fluid by passing it through a compressor in a fluid conduit. A portion of the working fluid is partially condensed in a first heat exchanger disposed downstream of the compressor to form a multiphasic working fluid. The method further comprises reducing pressure of the multiphasic working fluid by passing through an expansion valve disposed downstream of the first heat exchanger. A portion of the multiphasic working fluid is partially evaporated in a second heat exchanger disposed downstream of the expansion valve and upstream of the compressor. The method further comprises passing the multiphasic working fluid into a gas-liquid separation vessel disposed downstream of the second heat exchanger that separates the working fluid into a vapor stream that is directed to the compressor and a liquid stream that is directed to the first heat exchanger. The working fluid comprises the refrigerant blend having high glide that comprises a first refrigerant and a second refrigerant, where a difference in boiling points between the first refrigerant and the second refrigerant is greater than or equal to about 25° F. at atmospheric pressure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Figure 3A:
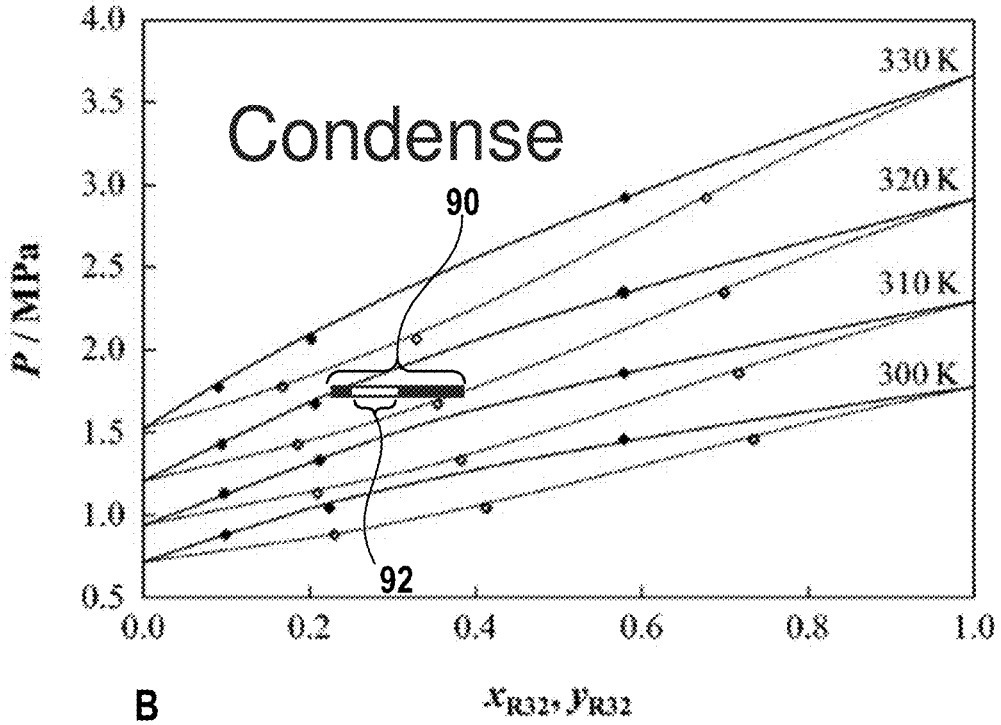
Figure 3B:
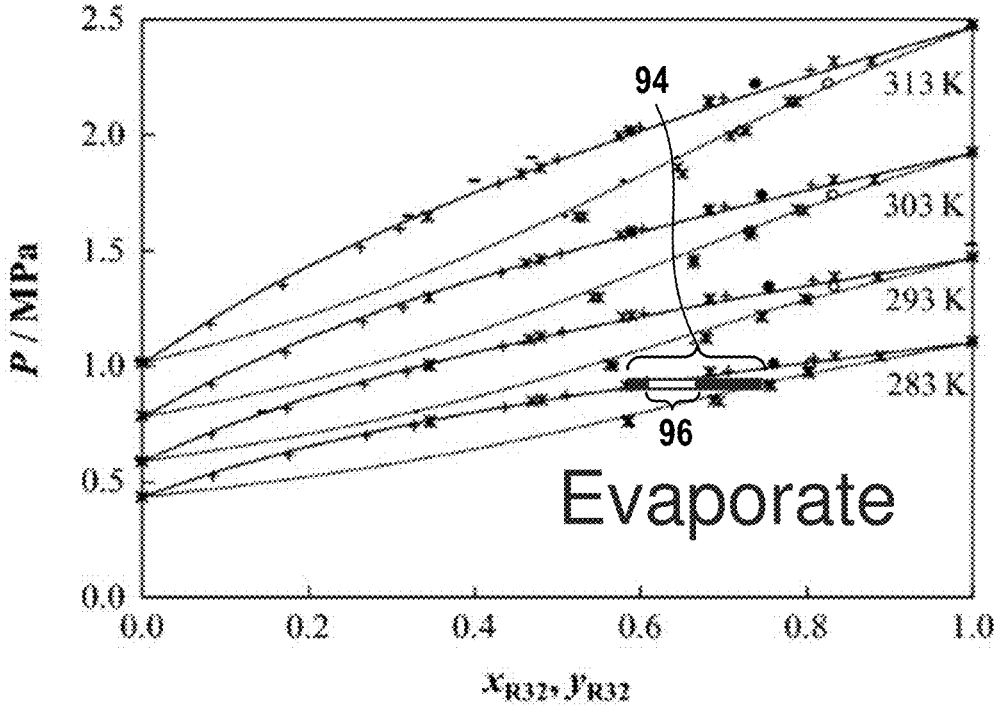

FIGS. 3A-3B show examples of concentration charts for a refrigerant blend with high glide (R-32 and R-1234yf) with mass fraction of liquid (x) versus gas (y) at different pressures to show phase changes. FIG. 3A shows condensation phase change for the refrigerant blend. FIG. 3B shows evaporation phase change for the refrigerant blend.

Figure 4:
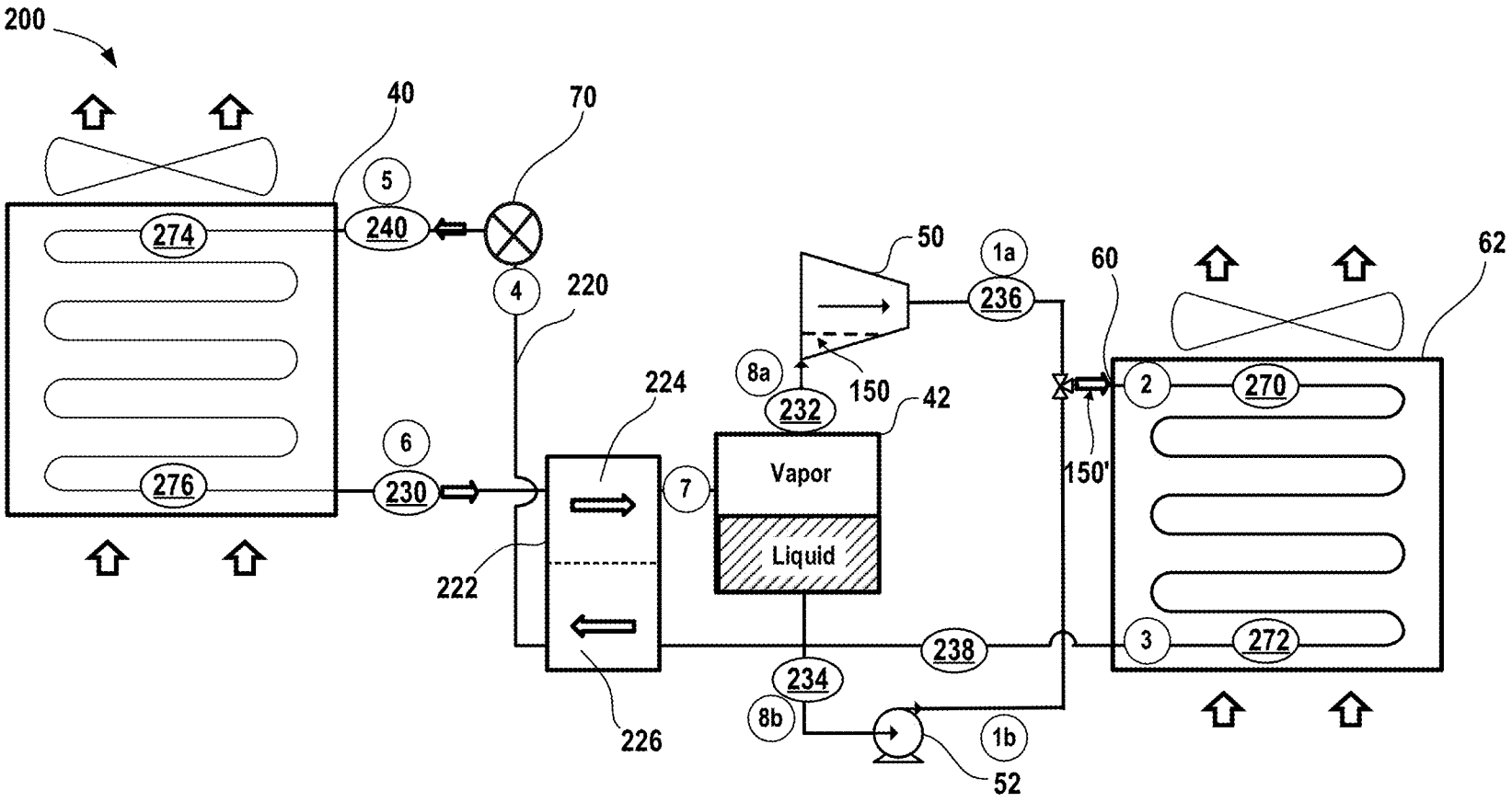

FIG. 4 shows a schematic of another example embodiment of a climate control system for circulating a working fluid having blended refrigerants that exhibits high glide prepared in accordance with certain aspects of the present disclosure. The climate control system includes a gas-liquid separation vessel and a liquid-to-suction heat exchanger.

Figure 5:
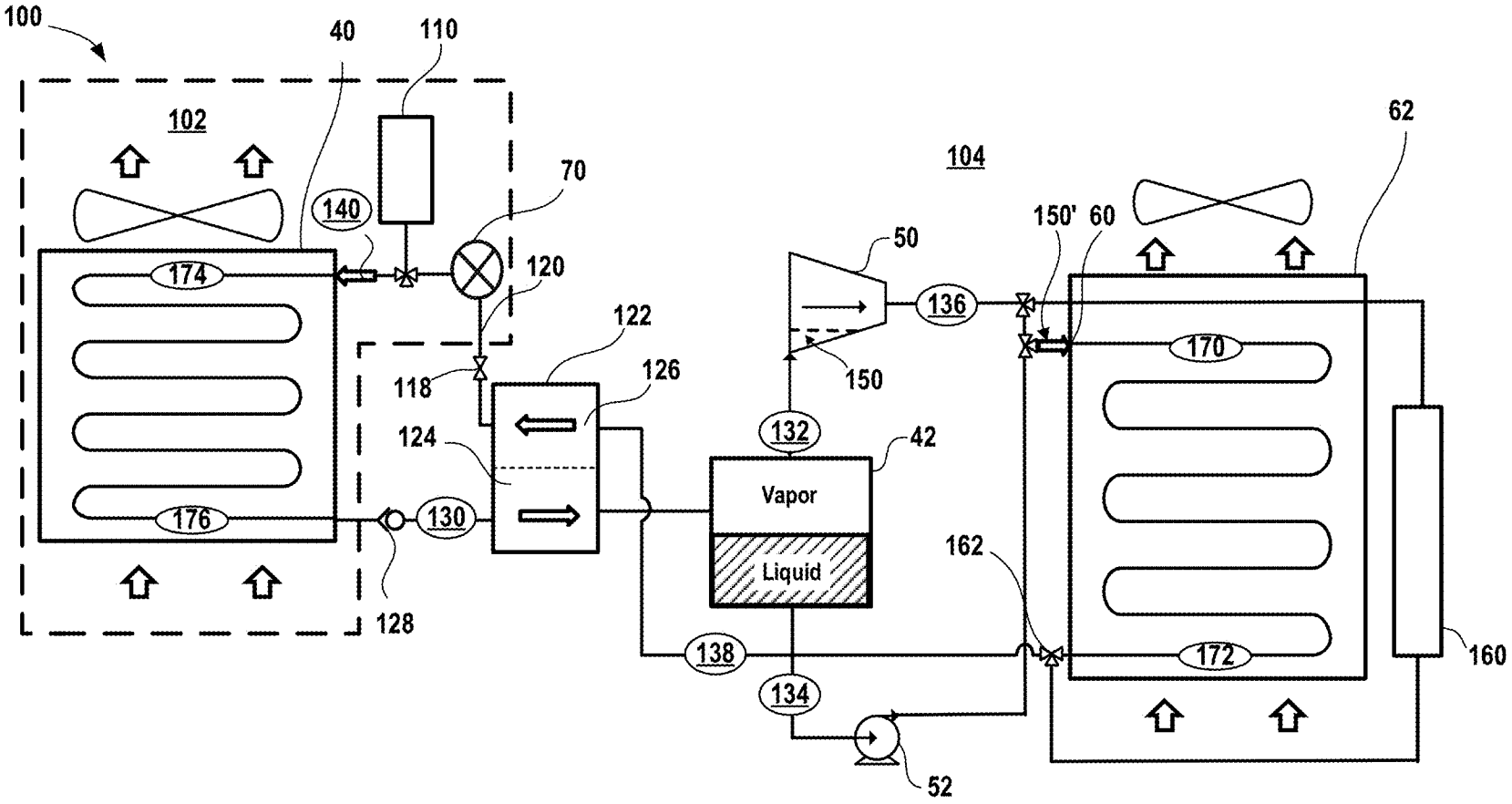

FIG. 5 shows a schematic of another example embodiment of a climate control system for circulating a working fluid having blended refrigerants that exhibits high glide prepared in accordance with certain aspects of the present disclosure. The climate control system includes a gas-liquid separation vessel, along with optional storage vessels, a liquid-to-suction heat exchanger, and an optional indoor region delineated and isolated by valves from an outdoor region (where a flammable refrigerant may be concentrated in the outdoor region).

Figure 6:
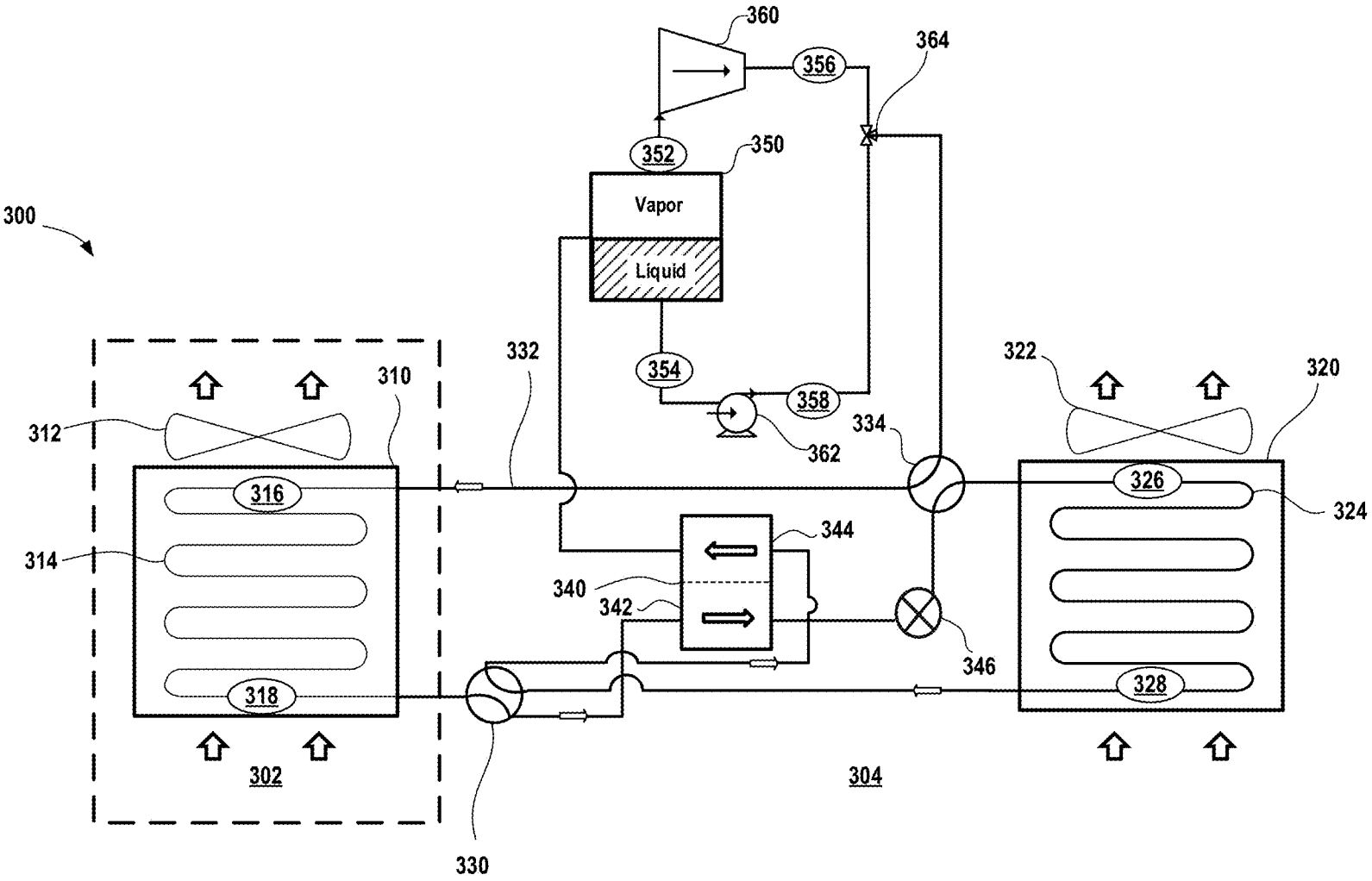

FIG. 6 shows a schematic of another example embodiment of a climate control system in the form of a heat pump system for circulating a working fluid having blended refrigerants that exhibits high glide prepared in accordance with certain aspects of the present disclosure. The heat pump system includes a gas-liquid separation vessel and a liquid-to-suction heat exchanger.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

In various aspects, the present disclosure pertains to climate control systems and methods of operating such systems that provide an ability to use working fluids having refrigerant blends including environmentally friendly refrigerants (for example, including one or more A1 refrigerants) that also exhibit extreme glide during operation. In taking advantage of such extreme glide, the climate control system advantageously can be capacity modulated. In certain aspects of the present disclosure, a "working fluid" composition for a refrigeration system for a heat transfer device, such as a compressor machine, includes a blend of at least two refrigerant(s). The working fluid can be modified in operation by further adding a lubricant having preferential affinity to at least one refrigerant to change the refrigerant blend concentration in circulation in the system. Working fluids for refrigeration systems generally include a minor amount of the lubricant composition, where the lubricant and refrigerant(s) are combined in amounts so that there is relatively more refrigerant than lubricant in the lubricant-refrigerant compositions. Based on the combined weight of lubricant and refrigerant, the refrigerant is greater than or equal to about 50% by weight and the lubricant is less than or equal to about 50% by weight of the combined weight. In various embodiments, the lubricant oil is greater than or equal to about 1 to less than or equal to about 30% by weight of the combined weight of lubricant and high energy refrigerant of from greater than or equal to about 5 to less than or equal to about 20% by weight of the combined weight of the working fluid. Typically, the working fluids include greater than or equal to about 5 to less than or equal to about 20 weight % or optionally greater than or equal to about 5 to less than or equal to about 15 weight % of lubricant with a balance being the refrigerant(s). In the context of the present disclosure, the working fluid may comprise at least two distinct refrigerants that form a blend of refrigerant compositions.

Certain refrigerant blends may suffer from fractionation and high glide, which traditionally have been considered problems to be avoided for in climate control systems. Many refrigerant blends exhibit temperature glide when they undergo phase changes in both the evaporator and condenser. As noted above, in the evaporator, the refrigerant evaporates or undergoes a phase change from a liquid to a vapor. In the condenser, the refrigerant condenses or undergoes a phase change from a vapor to a liquid. Refrigerant blends exhibit temperature glide, because there are multiple refrigerant molecules present with different properties. As these refrigerant blends change phase (evaporate and condense), a change in the refrigerant blend composition is observed due to preferential evaporation or condensation of the more or less volatile refrigerant components (also referred to as high-pressure and low-pressure refrigerants) in the blend of the refrigerants. This process is referred to as blend fractionation.

Thus, a total temperature glide of a refrigerant blend may be defined as a difference in temperature between a saturated vapor temperature and a saturated liquid temperature at a constant pressure. Stated in another way, glide may be considered to be a temperature difference between the starting and ending temperature of a refrigerant phase change within a system at a constant pressure.

In the context of certain aspects of the present technology, counterintuitively, a working fluid is intentionally selected that has a high glide refrigerant blend. In certain aspects, the refrigerant blend may comprise a first refrigerant with a relatively low normal boiling point (also referred to herein as a high-pressure refrigerant) and a second refrigerant with a relatively high normal boiling point (also referred to herein as a low-pressure refrigerant). In certain aspects, the first refrigerant may have a first (low) boiling point of greater than or equal to about −270° C. to less than or equal to about 8° C. Thus, the low boiling point refrigerant may have a boiling point in a range from hydrogen at −267° C. to R1336mzz(E) at 7.5° C. In certain aspects, the second refrigerant may have a second (high) boiling point of greater than or equal to about −55° C. to less than or equal to about 100° C. For example, the high boiling point refrigerant can range from R32 at approximately −52° C. to water ($H_2O$) at 100° C. As will be appreciated by those of skill in the art, the refrigerant components are selected to create a blend that meets the goals of the system in the application. A different blend may be selected for cryogenic applications, low temperature refrigeration, medium temperature refrigeration, air conditioning, and different process cooling applications, and the like.

Thus, the working fluid may comprise a first refrigerant and a second refrigerant having a difference in normal boiling points (e.g., ΔT=First Refrigerant Boiling Point ($BP_1$)−Second Refrigerant Boiling Point ($BP_2$)) of greater than or equal to about 25° F. (about 14° C.) at atmospheric pressure. The first refrigerant and a second refrigerant may be chosen for various properties, including respective normal boiling points, glide efficiency, global warming potential, environmental impact, such as polyfluoroalkyl substances (PFAS) impact, capacity, pressure, safety, and the like. In certain aspects, the difference in normal boiling points between the first refrigerant and the second refrigerant is greater than or equal to about 50° F. (28° C.), optionally greater than or equal to about 75° F. (42° C.), optionally greater than or equal to about 100° F. (55° C.), optionally greater than or equal to about 125° F. (69° C.), and in certain aspects, optionally greater than or equal to about 150° F. (83° C.) at atmospheric pressure.

By way of example, the present disclosure contemplates employing refrigerant blends comprising at least one refrigerant that has a low global warming potential, such as ASHRAE classified A1 and A2L refrigerants. In certain aspects, the refrigerant blend comprises an A1 refrigerant. As noted above, examples of A1 refrigerants include carbon dioxide (R-744), chlorodifluoromethane (R-22), 1,1,1,2-tetrafluoroethane (R134A), and R410A (a near-azeotropic mixture of difluoromethane (R-32) and pentafluoroethane (R-125)), and trifluoro,monochloropropenes (R-1233), including cis- and trans-1-chloro-3,3,3-trifluoropropene (HFO-1233zd) isomers (HFO-1233zd(Z) and HFO-1233zd (E)), and hexafluorobutenes (HFO-1336, including HFO-1336mzz(Z), 1336mzz(E)). A2L refrigerants include difluoromethane (R-32) and hydrofluorolefins (HFOs). Many suitable HFO refrigerants are described in U.S. Pat. No. 4,788,352 to Smutny and U.S. Pat. No. 8,444,874 to Singh et al., the relevant portions of which are incorporated herein by reference. The HFOs may include 2,3,3,3-tetrafluoroprop-1-ene (HFO-1234yf) and trans-1,3,3,3-tetrafluoroprop-1-ene (HFO-1234ze). Non-limiting suitable examples of specific HFO refrigerants include 3,3,3-trifluoropropene (HFO-1234zf), HFO-1234 refrigerants like 2,3,3,3-tetrafluoropropene (HFO-1234yf), 1,2,3,3-tetrafluoropropene (HFO-1234ze), cis- and trans-1,3,3,3-tetrafluoropropene (HFO-1234ye), pentafluoropropenes (HFO-1225) such as 1,1,3,3,3, pentafluoropropene (HFO-1225zc), hexafluorobutenes (HFO-1336), such as cis-1,1,1,4,4,4-hexafluoro-2-butene (HFO-1336mzz-Z) and trans-1,1,1,4,4,4-hexafluoro-2-butene (R1336mzz(E)), or those having a hydrogen on the terminal unsaturated carbon such as 1,2,3,3,3, pentafluoropropene (HFO-1225yez), fluorochloropropenes such as trifluoro,monochloropropenes (HFO-1233) like $CF_3CCl{=}CH_2$ (HFO-1233xf) and $CF_3CH{=}CHCl$ (HFO-1233zd) (including trans (E) and cis (Z) isomers (HFO-1233zd(E) and HFO-1233zd(Z)), (E)-1,2-difluoroethene (R-1132(E)), and any combinations thereof. In certain aspects, the HFO refrigerant may be selected from the group consisting of: R-1234yf, R-1234ze, R1233zd(E), R1233zd(Z), R1336mzz(Z), R1336mzz(E), R-1132(E), and combinations thereof.

According to certain variations, at least one refrigerant in the working fluid refrigerant blend used with present technology may comprise a refrigerant selected from the group consisting of: R-744, R-22, R134A, R410A, R-1234yf, R-1234ze, R1233zd(E), R1233zd(Z), R1336mzz(Z), R1336mzz(E), and combinations thereof.

In certain aspects, the first refrigerant and the second refrigerant are independently selected from the group consisting of: carbon dioxide (R-744), chlorodifluoromethane (R-22), 1,1,1,2-tetrafluoroethane (R134A), R410A (a near-azeotropic mixture of difluoromethane (R-32) and pentafluoroethane (R-125), dimethyl ether (R-E170), difluoromethane (R-32), hydrofluorolefins (HFOs), dimethyl ether (R-E170), propane (R-290), and combinations thereof.

The refrigerants may be used in combination with other A1 or A2L refrigerants or yet other refrigerants, such or A3 or B1 or B2 refrigerants, including natural or flammable refrigerants (e.g., dimethyl ether (R-E170), propane ($C_3H_8$ or R-290)).

In certain variations, the first refrigerant is selected from the group consisting of: carbon dioxide (R-744), chlorodifluoromethane (R-22), 1,1,1,2-tetrafluoroethane (R134A), R410A (a near-azeotropic mixture of difluoromethane (R-32) and pentafluoroethane (R-125), dimethyl ether (R-E170), difluoromethane (R-32), hydrofluorolefins (HFOs), and combinations thereof, while the second refrigerant is selected from the group consisting of: 2,3,3,3-tetrafluoroprop-1-ene (R-1234yf), 1,3,3,3-tetrafluoroprop-1-ene (R-1234ze), 1-chloro-3,3,3-trifluoropropene (HFO-1233zd(E), 1-chloro-3,3,3-trifluoropropene (HFO-1233zd (Z), HFO-1233zd(Z))1,1,1,4,4,4-hexafluoro-2-butene (HFO-1336mzz), and combinations thereof.

In certain aspects, the refrigerant blend includes an A1 refrigerant, carbon dioxide (R-744), mixed with at least one other refrigerant. The carbon dioxide refrigerant is desirably used in a sub-critical system design. One example of a suitable, non-limiting refrigerant blend includes $CO_2$ (R-744) as the more volatile, high-pressure refrigerant mixed with R1234yf as the less volatile, low-pressure fluid. In such an example, the refrigerant blend has a first refrigerant comprising $CO_2$ with a normal boiling point (at 1 atmosphere (atm.) of pressure) of approximately −78° C. and a second refrigerant comprising R1234yf with a normal boiling point of approximately −29° C. at 1 atm. of pressure, so that a difference in boiling points is about 49° C.

In another variation, the refrigerant blend may include an A1 refrigerant, such as $CO_2$ (R-744) mixed with a flammable refrigerant (ASHRAE 34 class A3) such as propane ($C_3H_8$ or R-290) or dimethyl ether (R-E170). In this example, the refrigerant blend has a first refrigerant comprising $CO_2$ with a normal boiling point of approximately −78° C. and a second refrigerant comprising R-E170 with a normal boiling point of approximately −24° C., so that a difference in boiling points is about 54° C. As described further below, the climate control system can maintain a ratio of A1 refrigerant to limit the amount of flammable refrigerant on the indoor side of the system to a safe level.

While an amount of refrigerant present in the working fluid may vary at different points in the system and may be based on particular system requirements, in certain variations, the working fluid charged into the system may include a first refrigerant that may be a more volatile, high-pressure refrigerant present at greater than or equal to about 5% by weight to less than or equal to about 95% by weight and the second refrigerant may be a less volatile, low-pressure refrigerant that is present at greater than or equal to about 5% by weight to less than or equal to about 95% by weight based on the combined weight of all refrigerants. In one example, the working fluid does not need to have a large quantity of a fluid with a lower critical point, namely the second refrigerant, blended with a first refrigerant, such as $CO_2$ (R-744), to advantageously keep the $CO_2$ out of a transcritical operating regime. In certain variations, the first refrigerant may be a more volatile, high-pressure refrigerant present at greater than or equal to about 50% by weight and the second refrigerant may be a less volatile, low-pressure refrigerant that is present at less than or equal to about 50% by weight based on the combined weight of all refrigerants.

In this manner, fractionation may be a phenomenon that enables a variable blend refrigerant, so that fractionation can be used in the climate control system, for example by use of heat exchangers (e.g., evaporator and condensers) and/or storage vessels to separate streams into different concentrations. Thus, the refrigerant flow may allow only a small portion of a phase change to occur in each heat exchanger. Only a portion of the total glide is experienced in partial phase change. For example, a liquid stream having a high concentration of less volatile, low-pressure liquid that is not evaporated can optionally be stored and then pumped into the discharge of a compressor, bypassing the compression cycle, as it enters the condenser. In another variation, a high concentration of more volatile, high-pressure gas forms from refrigerant that is not condensed, but is released into the evaporator inlet. In this manner, as will be described in further detail below, the head is reduced and the glide is taken from a portion of the two-phase region.

As will be described in more detail below, refrigeration lubricant oils known to be suitable for use with such refrigerants are contemplated. The working fluid may comprise a synthetic oil. In certain variations, the lubricant oil may comprise a polyvinyl ether (PVE) oil, a polyalphaolefin (PAO), a polyalkylene glycol (PAG), alkylbenzene, mineral oil, or an ester-based oil, such as polyol ester (POE) oil. In certain variations, for example, the lubricant oil may comprise a polyol ester (POE) compound formed from a carboxylic acid and a polyol. In certain variations, such a POE may be formed from a carboxylic acid selected from a group consisting of: n-pentanoic acid, 2-methylbutanoic acid, n-hexanoic acid, n-heptanoic acid, 3,3,5-trimethylhexanoic acid, 2-ethylhexanoic acid, n-octanoic acid, n-nonanoic acid, and isononanoic acid, and combinations thereof and a polyol selected from a group consisting of: pentaerythritol, dipentaerythritol, neopentyl glycol, trimethylpropanol, and combinations thereof. Where carbon dioxide (R-744) is present in the refrigerant blend, in certain variations, the lubricant may comprise a polyol ester oil (POE) oil. For example, one particularly suitable lubricant oil is a polyol ester oil designated 3MAF, which is a reaction product of pentaerythritol (nominally about 78% to 91% and dipentaerythritol (nominally about 9% to 22%)) polyols with carboxylic acids (valeric acid nominally at 29% to 34%, heptanoic acid nominally at 34% to 44%, and 3,5,5-trimethyl hexanoic acid nominally at 22% to 37%).

In various aspects, the climate control systems contemplated by the present disclosure provide the ability to use the extreme glide properties of a refrigerant blend during operation, which allows components to be isolated and stored in a concentrated state, which can then change the concentration of the blend at the compressor suction in order to enable high density gas compression for enhanced capacity and variable density gas compression for system capacity modulation, for example.

In certain aspects, methods of operating climate control systems may include using such a working fluid comprising at least a first refrigerant and a second distinct refrigerant, where the evaporation and condensation of the refrigerant blend/working fluid is only partial, thus resulting in a specialized vapor compression cooling/heating cycle. For example, a pressure rise of a two-phase refrigerant blend may be performed by the steps of separating liquid and vapor of the refrigerant blend, compressing the vapor, while pumping the liquid.

A conventional thermodynamic climate control system such as, for example, a heat-pump system, a refrigeration system, or an air conditioning system configured to use a high glide refrigerant blend is contemplated by certain aspects of the present disclosure. In various aspects, the present disclosure pertains to climate control systems used in a wide variety of refrigeration and heat energy transfer applications, in some cases, to industrial or commercial air-conditioning or refrigeration units, e.g., for factories, office buildings, apartment buildings, warehouses, and ice skating rinks, or for retail sale.

Figure 1:
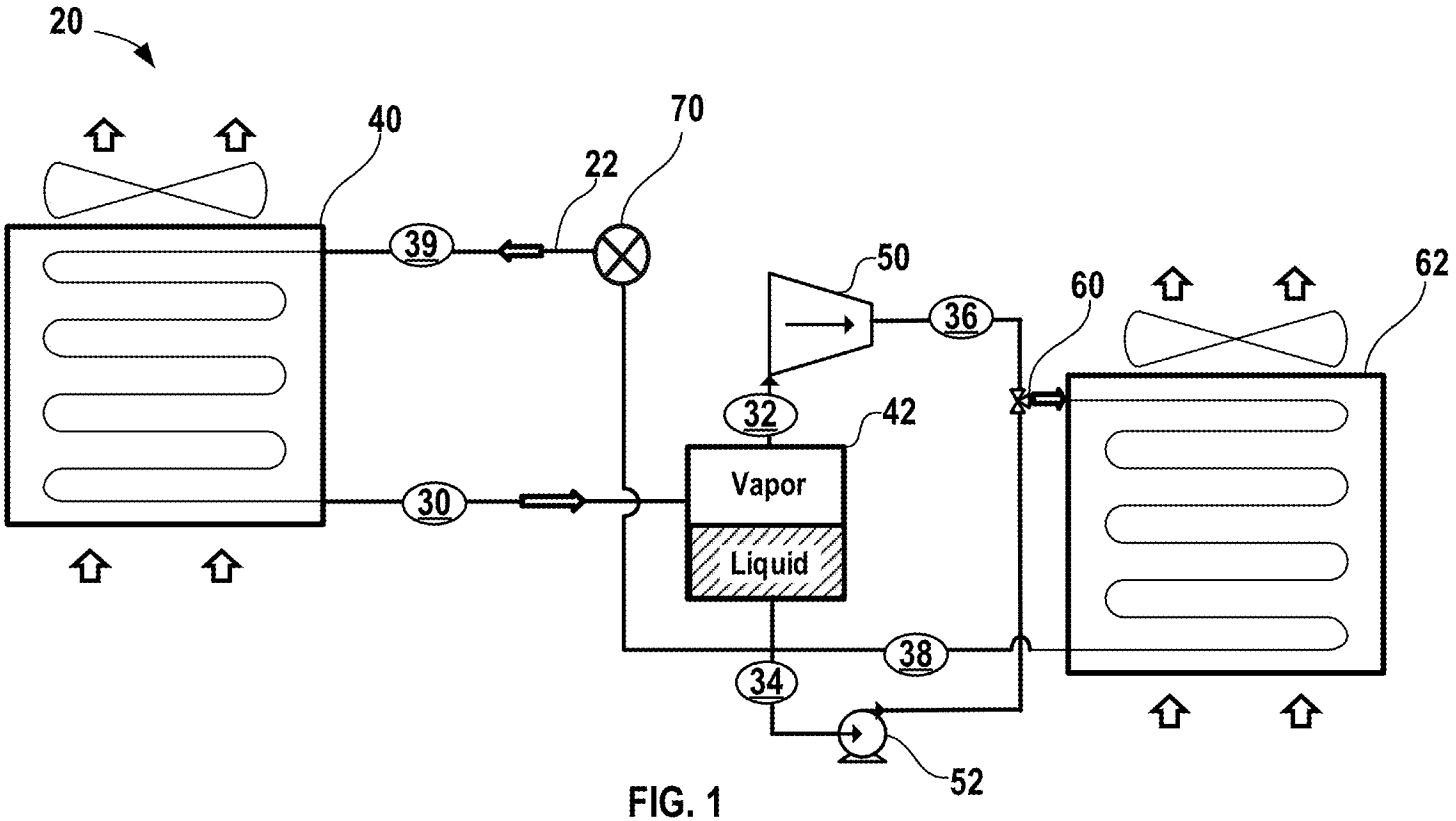
FIG. 1 shows a schematic of an example embodiment of a climate control system for circulating a working fluid having blended refrigerants that exhibits high glide prepared in accordance with certain aspects of the present disclosure that includes a gas-liquid separation vessel.

By way of example, FIG. 1 shows a schematic of an example of a simplified climate control system 20, such as a refrigeration system, that processes and circulates a working fluid having a composition comprising at least a first refrigerant (A) and a second refrigerant (B) that exhibit high glide. The capacity of the climate control system 20 may be modulated by changing relative proportions of first refrigerant (A) and second refrigerant (B) in the working fluid blend at different points in the system. Therefore, a resulting density of the compressor suction is modified by preferentially storing concentrated amounts of first refrigerant (A) or second refrigerant (B) in one or more select regions of the system. In various aspects, the present disclosure provides a vapor compression system that is configured to incompletely evaporate and condense refrigerant.

As discussed above, more than two refrigerants may be present, but for simplicity, two refrigerants are used in this example and a difference in boiling points between the first refrigerant (A) and the second refrigerant (B) is greater than or equal to about 25° F. at atmospheric pressure. The working fluid may also include oil(s) at certain points in the system, as will be described in greater detail below. The term "fluid" as used herein encompasses liquid, gas, and any combinations thereof, including vapor (e.g., a gas phase having aerosolized liquid droplets). The term gas or gas phase as used herein is intended to encompass both vapor and pure gas phases.

The climate control system 20 has a fluid flow path or fluid conduit 22 that establishes fluid communication between the various components, so that the working fluid may circulate in a loop as discussed further herein. First, the working fluid including the first refrigerant (A) and second refrigerant (B) may enter a first heat exchanger in the form of the evaporator 40. The evaporator 40 causes first refrigerant (A) and/or second refrigerant (B) to transform from a liquid phase to a gas or vapor phase as it exits the evaporator 40 at point 30, where the cooling effect of endothermic energy absorption occurs. The refrigerant(s) typically evaporate at a lower pressure withdrawing heat from the surrounding zone. Air flowing through the evaporator 40 is shown by arrows, which is cooled. As shown, the air flows in a countercurrent arrangement, although concurrent or other air flow configurations may also be used. The heat exchangers (evaporator 40 and condenser 62 discussed below) may include concentric, finned tube, brazed plate, plate and frame, microchannel, or other heat exchangers. There may be a single evaporator and condenser or multiple evaporators or condensers in parallel or series configurations. Refrigerant flow therein can be controlled via a capillary tube, thermostatic expansion valve, electric expansion valve, or other methods. In heat pump systems, the roles of the evaporator 40 and the condenser 62 may be changed based on whether heating or cooling of a space is being performed.

The evaporator 40 may be located in a room or space to be cooled by the climate control system 20 or used to cool air flowing into a room or space in which cooling is desired. Thus, the evaporator 40 receives and at least partially vaporizes the low-pressure multiphase working fluid at point 39 and directs the working fluid to a downstream gas-liquid/liquid-vapor separating vessel or flash tank 42.

At point 30 in the fluid conduit 22, the working fluid comprises a combination of both first refrigerant (A) and second refrigerant (B) that are partially or fully in gas phase. Working fluid at point 30 may be a multiphase composition. As noted above, one aspect of the present technology is that the working fluid having the refrigerant blend with first refrigerant (A) and second refrigerant (B) is only partially evaporated to form a mixture of both gas/vapor and liquid. For example, the first refrigerant (A) may have a lower boiling point and is thus more volatile, so a greater amount of first refrigerant (A) volatizes or evaporates, while second refrigerant (B) has a higher boiling point and thus a lower proportion of second refrigerant (B) evaporates or volatilizes in the working fluid and thus a larger proportion remains in liquid form. In certain aspects, a portion of the first refrigerant (A) may be in gas or vapor form, for example, greater than or equal to about 20% to less than or equal to about 50% by volume, while a remaining percentage of the first refrigerant (A) may be in a liquid phase. The presence of the gas-liquid separator (e.g., flash tank) in the climate control system provides an ability to control how much of a temperature range for the refrigerant blend is being used. By way of example, the vapor quality, or mass fraction of vapor of the working fluid at point 30 that exits the evaporator may be predetermined to be any amount, for example from greater than or equal to about 15% to about 100% vapor quality, by way of non-limiting example, depending on an amount of liquid evaporated.

Assuming that at least a portion of the working fluid in conduit 22 at point 30 includes the second refrigerant (B) in liquid form, the working fluid passes into a gas-liquid separation vessel or flash tank 42 that receives the working fluid and generates a vapor stream 32 and a liquid stream 34. The working fluid at this point 30 is thus separated into two distinct streams, a first vapor stream at point 32 and a second liquid stream at point 34. The vapor stream 32 may include gas or vapor phase refrigerants, including substantially more volatile first refrigerant (A) and a portion of the less volatile second refrigerant (B), depending on desired operating conditions. The liquid stream 34 may comprise the second refrigerant (B) in a liquid phase, for example, in certain variations, a majority of the liquid stream 34 may be second refrigerant (B).

The vapor stream 32 passes into a compressor 50 where it is compressed to increase pressure and form a high-pressure vapor or gas stream 36 exiting the compressor 50. The compressor 50 may be a variety of different compressors known in the art. Types of compressors useful for the above application can be classified into two broad categories, both positive displacement and dynamic compressors. Positive displacement compressors increase refrigerant vapor pressure by reducing the volume of the compression chamber through work applied to the compressor's mechanism. Positive displacement compressors include many styles of compressors currently in use, such as reciprocating, rotary (rolling piston, rotary vane, single screw, twin screw), and orbital (scroll or trochoidal). Dynamic compressors increase refrigerant vapor pressure by continuous transfer of kinetic energy to the vapor in a compression mechanism in the form of a rotating member, followed by conversion of this energy into a pressure rise. Centrifugal compressors function based on these principles. Details of the design and function of these compressors for refrigeration applications can be found in the 2010 ASHRAE Handbook, HVAC systems and Equipment, Chapter 37, incorporated herein by reference. In certain variations, the compressor 50 may be a scroll compressor or a reciprocating compressor, by way of example.

A high-pressure or pressurized gas stream 36 exiting the compressor 50 has a pressure that is significantly greater than the pressure of vapor stream 32. The mechanical energy required for compressing the vapor and pumping the fluid in the compression mechanism of the compressor is provided by, for example, an electric motor or internal combustion engine. Notably, in certain aspects, the climate control system 20 provides a turndown without requiring traditional compressor modulation techniques by changing a density of the refrigerants in the working fluid at the inlet of the compressor 50.

The liquid stream 34 from the flash tank 42 passes into pump 52, where a pressure of the liquid stream 34 in increased. After passing through the pump 52, the high-pressure liquid stream 34 is then directed towards the inlet 60 of the condenser 62.

The condenser 62 is thus disposed downstream of the compressor 50 and pump 52 and thus receives and cools the pressurized gas stream 36 and receives high-pressure liquid stream 34 to generate a condensing multiphase working fluid stream 38. Thus, the stream that enters the inlet 60 of the condenser 62 is a blended stream of high-pressure vapor and liquid. By way of example, the vapor quality, or mass fraction of vapor of the working fluid that enters the condenser inlet 60 and thus the condenser 62 may be predetermined to be an amount ranging from at greater than or equal to about 10% vapor quality to less than or equal to about 90% vapor quality, such as 30% vapor quality, optionally 40% vapor quality, and the like, by way of non-limiting example, depending on an amount of liquid pumped from the flash tank 42 through pump 52 and blended with the pressurized gas stream 36.

In the condenser 62, pressurized gas stream 36 transforms from a vapor phase to a liquid phase (for example, first refrigerant (A) transforms from vapor to liquid). The condenser 62 may also receive liquid stream 34 (comprising the second refrigerant (B)) that is circulated via pump 52 and directed towards inlet 60, where it also may enter the condenser 62. Thus, the pressurized gas stream 36 is potentially blended with high-pressure liquid stream 34 that enters the condenser 62. In the condenser 62, the working fluid is cooled by condensing that expels heat from the climate control system 20, as shown by the arrows reflecting airflow. The condenser 62 may be located in a room or space where heat may be expelled, for example, outdoors. As noted above, one aspect of the present technology is that the working fluid having the refrigerant blend with first refrigerant (A) and second refrigerant (B) may be only partially condensed to form a multiphase mixture of both liquid and optionally gas/vapor.

The working fluid exiting the condenser 62 at point 38 may thus comprise both first refrigerant (A) and second refrigerant (B) that are partially or fully in liquid phase. The working fluid condensate at point 38 is then circulated in fluid conduit 22 through an expansion device, such as an expansion valve 70, to the evaporator 40, so completing the refrigerant cycle. The expansion valve 70 is disposed between the condenser and the evaporator. At the expansion valve 70, pressure of the working fluid is reduced. As will be appreciated by those of skill in the art, conventional components used with the climate control system 20 may not be shown, including flow rate, temperature, and pressure monitors, actuators, valves, controllers and the like.

Figure 2:
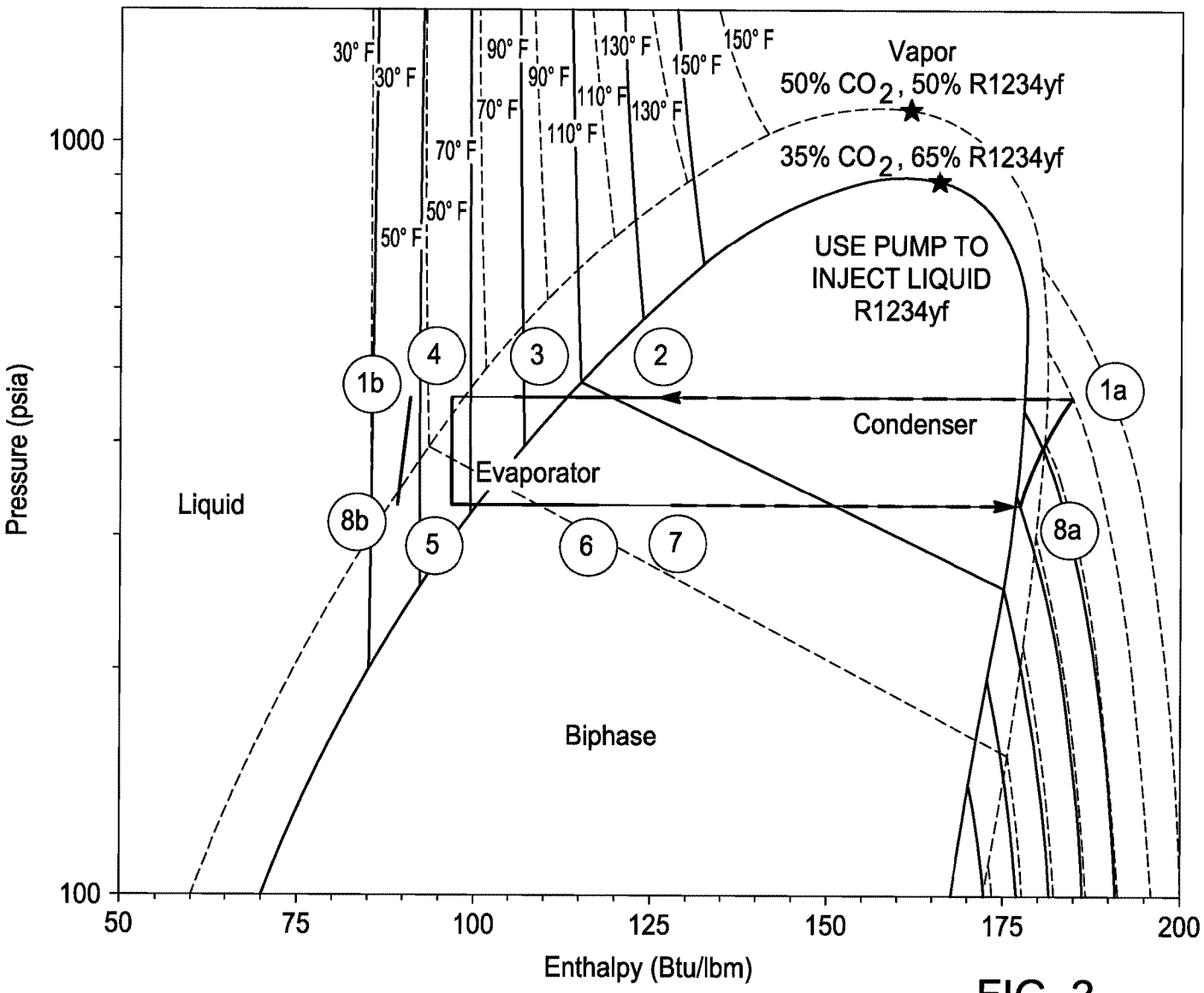
FIG. 2 is a pressure and enthalpy phase diagram illustrating principles of operation of a climate control system using an example refrigerant blend comprising R-744 and R1234yf at different concentrations according to certain aspects of the present disclosure.

FIG. 2 shows a pressure versus enthalpy phase diagram for constant temperatures illustrating certain principles of the working fluids including refrigerant blends having high glide according to certain principles of the present disclosure. In FIG. 2, a non-limiting example of the refrigerant blend is carbon dioxide ($CO_2$/R-744) and R1234yf, where an upper curve has 50% $CO_2$ and 50% R-1234yf, while a lower curve has 35% $CO_2$ and 65% R1234yf. $CO_2$ would be considered to be the lower boiling point, high-pressure refrigerant (A), while R-1234yf is the higher boiling point, low-pressure refrigerant (B). A stream having a high concentration of low-pressure (R-1234yf) liquid forms from refrigerant that is not evaporated and is pumped or injected into the discharge of the condenser (being pumped and bypassing the compressor). A stream of high concentration high-pressure gas ($CO_2$) forms from refrigerant that is not condensed, but is released into the evaporator inlet. In this manner, the head is reduced and the glide is taken from a portion of the two-phase region.

Notably, the state points described herein with respect to FIG. 2 are also shown in the system of FIG. 5. More specifically, State 1a shows vapor as it exits the compressor, where the vapor has the highest pressure and enthalpy than at any other point in the climate control system 20. State 1b shows discharge from the liquid pump. The discharge from the compressor (State 1a) and discharge from the pump (State 1b) are combined together to a form a two-phase working fluid comprising a blend of at least two refrigerants corresponding to State 2. As the working fluid with the refrigerant blend enters and passes through the condenser (between Points 2 and 3), the working fluid comprising the refrigerants releases heat and thereby loses enthalpy, while maintaining pressure, as it exits the condenser. Where the refrigerants are only partially condensed, point 2 falls inside the biphasic (vapor and liquid) operating envelope, rather than in the liquid phase region as in traditional systems. As shown in FIG. 2, the refrigerant blend selected for use in accordance with certain aspects of the present disclosure exhibits a high glide in the biphasic region, corresponding to fractionation that occurs between 30° F. to 150° F. or a glide temperature of about 120° F. depending on the refrigerant blend composition. This means that the biphasic region where fractionation into gas and liquid occurs is a relatively expansive region that can be used in accordance with certain aspects of the present disclosure to modulate system performance.

Thus, heat/enthalpy is removed from the two-phase fluid in the condenser to form a lower vapor-quality two-phase working fluid, to either a saturated liquid or a subcooled liquid (State 3). The working fluid condition at State 3 may be cooled by heat exchange with working fluid leaving the evaporator to form a saturated liquid or subcooled state working fluid corresponding to State 4.

The pressure of the fluid that has been condensed and potentially subcooled (State 4) is reduced by expanding the fluid as it passes through a valve or orifice (e.g., an expansion valve) so that it has a lower pressure at the same enthalpy (State 5). The low-pressure liquid or low vapor-quality (e.g., having lower vapor/gas and greater amounts of liquid) working fluid after the expansion (State 5) thus absorbs heat from a stream of air or secondary fluid in an evaporator to form a two-phase working fluid corresponding to State 6. The refrigerant blend enters the evaporator, where heat is absorbed and enthalpy increased so that the refrigerants are at least partially or fully vaporized to reach State 6. Where the refrigerants are only partially evaporated, the points are inside the biphasic (vapor and liquid) envelope.

The two-phase working fluid leaving the evaporator is further heated by a fluid leaving the condenser via heat exchange to become a two-phase working fluid of a higher vapor-quality (e.g., having relatively greater amounts of vapor/gas) (State 7). As described above, portions of the stream leaving the evaporator in liquid phase (for example, comprising greater portions of the low-pressure, low volatility second refrigerant (B)) may be separated in a gas-liquid separator (e.g., liquid stream 34 exiting the flash tank 42 in FIG. 1) drawn off and separated from a vapor/gas stream (e.g., vapor stream 32) prior to entering the compressor. The higher vapor-quality low-pressure two-phase fluid is thus separated between liquid and vapor phases in a liquid-vapor separating vessel or flash tank flash tank to form a saturated liquid stream (State 8b) and a saturated vapor stream (State 8a). The pressure of the vapor is increased to a higher pressure by a compressor to a discharge state (State 1a). The pressure of the liquid is increased to a higher pressure by a liquid pump to a discharge state (State 1b).

FIGS. 3A-3B show example concentration charts for a refrigerant blend of R-32 and R-1234yf, with mass fraction of liquid (x) versus gas (y) at different pressures to show phase changes. R-32 would be considered to be the lower boiling point, high-pressure refrigerant (A) above, while R-1234yf is the higher boiling point, low-pressure refrigerant (B). Fractionation of the refrigerant blend can enable a variable blend refrigerant used in accordance with certain aspects of the present disclosure. As shown in FIG. 3A, a full phase change during condensation occurs at line 90 for this refrigerant blend, while a partial phase change may occur across a portion of the line (an example of a partial phase change is designated 92). Likewise, in FIG. 3B, the phase change that occurs during evaporation is shown at line 94, while an example of a partial phase change occurs across the line designated 96. Thus, fractionation is used in heat exchangers (e.g., the evaporator or condenser) to separate streams of the working fluid into different concentrations of refrigerant (R-32 or R-1234yf). Moreover, the refrigerant flows may only allow a small portion of the phase change to occur in each heat exchanger (for example, the partial phase change shown at 92 or 96). As such, only a portion of the total glide is experienced in partial phase change.

In FIG. 4, a climate control system 200 is shown that processes and circulates a working fluid having a composition comprising first refrigerant (A) and second refrigerant (B) with corresponding state points as those described in the context of FIG. 2. To the extent that the components are similar to those described in FIG. 1, the same reference numbers will be used and unless otherwise addressed, for brevity, will not be discussed again herein. As will be appreciated by those of skill in the art, any of the features and components described in the context of FIG. 4 may be used individually or in combination in the climate control system described in the context of FIG. 1. At point 240 corresponding to State 5 discussed above, a low-pressure multiphase working fluid enters the evaporator 40, where first refrigerant (A) and second refrigerant (B) may transform from a liquid phase to a gas or vapor phase upon exiting at point 30 corresponding to State 6. The working fluid exiting the evaporator 40 at point 230 (State 6) then enters a heat exchanger that may be a liquid-to-suction heat exchanger 222.

Generally, the liquid-to-suction heat exchanger 222 transfers heat between the relatively hot condensate liquid exiting the condenser 62 and colder biphasic fluid exiting the evaporator 40. More specifically, the hotter condensate liquid can increase the temperature and vapor quality from the evaporator in a suction heat exchanger to provide a higher level of sub-cooling or a lower temperature and lower vapor quality of the condensate effluent to increase the evaporator capacity. Thus, the liquid-to-suction heat exchanger 222 can provide certain advantages in the climate control system 200, including further cooling the liquid refrigerant prior to it entering expansion valve 70, which can increase system efficiency, can reduce possible flashing in the liquid line and enable the expansion valve to operate with greater stability. In this manner, the partially evaporated refrigerant is further evaporated by heat transfer with slightly warmer partially condensed (or performs subcooling of) refrigerant from the same cycle. Further, the suction to liquid-to-suction heat exchanger 222 does not superheat the suction gas in certain variations.

A first side 224 of the liquid-to-suction heat exchanger 222 receives the multiphase working fluid exiting evaporator 40. Notably, any of the design configurations described above in the context of evaporators or condensers for countercurrent heat exchange are suitable for use as the liquid-to-suction heat exchanger 222. A second side 226 of the liquid-to-suction heat exchanger 222 in heat exchange relationship with the first side 224 receives working fluid exiting the condenser 62 at point 238 (State 3) that may thus comprise both first refrigerant (A) and second refrigerant (B) that are partially or fully in liquid phase. Thus, the condensed working fluid at point 238 passes on the second side 226 and transfers heat to the partially evaporated stream 230 leaving the evaporator 40 on the first side 224 of liquid-to-suction heat exchanger 222. After passing through the first side 224 of the liquid-to-suction heat exchanger 222, the multiphase working fluid is at State 7 and then passes into flash tank 42, where it is separated into first vapor stream 232 (corresponding to State 8a) and second liquid stream 234 (corresponding to State 8b). After passing through the second side 226, the working fluid condensate is at State 4 and continues through fluid conduit 220 to expansion valve 70. In certain aspects, a balance of refrigerant charge in the system can be modified by operating with less subcooling at the outlet on the second side 226 of the liquid-to-suction heat exchanger 222.

In certain aspects, an amount of heat transferred by the liquid-to-suction heat exchanger 222 is expressed by a difference in temperature ($\Delta T$) between a first temperature ($T_1$) of the working fluid at point 238 and a second temperature ($T_2$) of the working fluid at point 230. In certain variations, a difference between the first temperature ($T_1$) at point 238 and the second temperature ($T_2$) at point 230 may be greater than or equal to about 5° C. (where the second temperature $T_2$ is at least about 5° C. below the first temperature $T_1$), optionally greater than or equal to about 10° C., optionally greater than or equal to about 15° C., optionally greater than or equal to about 20° C., optionally greater than or equal to about 30° C., optionally greater than or equal to about 40° C., optionally greater than or equal to about 50° C., optionally greater than or equal to about 60° C., optionally greater than or equal to about 70° C., optionally greater than or equal to about 80° C., optionally greater than or equal to about 90° C., and in certain variations, optionally greater than or equal to about 100° C.

In one non-limiting example of operation of a climate control system, a discharge temperature at the compressor 50 at point 236 may be 157° F. As the vapor enters the condenser inlet 60 and blends with liquid stream 234, it may have State 2 and a temperature at point 270 may be 110° F. The condenser 62 may be operated to reduce temperature of the working fluid down to about 95° F. at point 272 corresponding to State 3. After passing through the liquid-to-suction heat exchanger 222, a temperature at point 274 in the evaporator 40 may be about 47° F. At point 276, the working fluid may have a temperature of about 75° F. A temperature increase within the evaporator 40 is about 29° F. In this scenario, a temperature of the stream entering the second side of the liquid-to-suction heat exchanger 222 is about 95° F., while the stream entering the first side of the liquid-to-suction heat exchanger 222 is about 75° F., where the stream exiting the second side is about 25° F., which amounts to a temperature reduction of about 20° F. after passing through the liquid-to-suction heat exchanger 222.

In certain aspects, the gas-liquid separation vessel or flash tank 42 that is downstream of the evaporator 40 may have excess capacity for storage of additional refrigerant or may be associated with an ancillary storage tank. In certain aspects, a residence time of the refrigerant in the flash tank 42 may be greater than or equal to about 30 seconds to less than or equal to about 10 minutes. In this manner, the flash tank 42 can also store refrigerant to balance the refrigerant in the climate control system 200, for example, to allow more or less subcooling in the condenser 62 and/or second side 226 of the liquid-to-suction heat exchanger 222.

As shown by the arrows in FIG. 4, the working fluid circulates in countercurrent flow arrangement to the flow of air as the heat transfer medium (e.g., ambient air) that passes through the evaporator 40 and condenser 62. A temperature range of the high glide refrigerant blend may be operated to be about 50% to about 200%, optionally about 66% to about 150% of the temperature range of the air circulated through the evaporator 40 and/or condenser 62. A direction of the refrigerant/working fluid flow in the conduit 220 is generally opposite to a flow direction of the air to accomplish the benefits of counter flow in a high glide system.

A working fluid exiting the condenser 62 at point 38 may thus comprise both first refrigerant (A) and second refrigerant (B) that are partially or fully in liquid phase. Thus, the condensed working fluid at point 38 passes on the first side 212 and transfers heat to the heat transfer media that circulates in the secondary loop 232. In certain aspects, the heat transfer media may cool the condensed working fluid prior to passing through the expansion valve 70 and into the evaporator 40. Thus, the working fluid at point 39 may be subcooled to the extent desired. In certain aspects, a balance of refrigerant charge in the system can be modified by operating with less subcooling at the outlet on the first side 212 of the heat exchanger 210.

The flow of air through the evaporator 40 and condenser 62 may be lower than industry rules of thumb or standard flows, as the counter flow of temperature gliding refrigerant in conduit 220 reduces the impact that results from high temperature splits on the secondary fluid (air).

In FIG. 5, another variation of a climate control system 100 is shown that processes and circulates a working fluid having a composition comprising first refrigerant (A) and second refrigerant (B). The climate control system 100 in FIG. 5 is similar to the climate control system shown in FIGS. 1 and 4, but further includes various optional components, such as one or more accumulator tanks, a buffering/high-pressure refrigerant storage vessel, and the like. Moreover, an optional delineation is shown where the system may be separated into indoor and outdoor portions, so that a flammable refrigerant may be used in the working fluid that may be isolated to an outdoor portion. The capacity of the climate control system 100 may be modulated by changing relative proportions of first refrigerant (A) and second refrigerant (B) blend at different points in the system and therefore a resulting density of the compressor suction by preferentially storing concentrated amounts of first refrigerant (A) or second refrigerant (B) refrigerant in one or more select regions of the system. To the extent that the components are similar to those described in FIGS. 1 and 4, the same reference numbers will be used and unless otherwise addressed, for brevity, will not be discussed again herein. As will be appreciated by those of skill in the art, any of the features and components described in the context of FIG. 5 may be used individually or in combination in the climate control system described in the context of FIG. 1 or 4.

In FIG. 5, while not limiting, portions of the climate control system 100 that may optionally be located indoors 102 or in confined spaces are delineated by the dotted line, while the remaining portions of the climate control system 100 may be located outdoors 104, so that in certain variations, a flammable refrigerant concentration in the blend may be higher and/or isolated to use outdoors, where potential leaks are less problematic. An accumulator 110 or other refrigerant storage device is optionally disposed in a fluid flow path or fluid conduit 120 upstream of evaporator 40, corresponding to a point where the liquid in the system is relatively high, for example, having a high concentration of the lower pressure second refrigerant (B).

At point 140, a low-pressure multiphase working fluid enters the evaporator 40, where first refrigerant (A) and second refrigerant (B) may transform from a liquid phase to a gas or vapor phase upon exiting at point 130. In a first operating scenario, an amount of refrigerant (e.g., second refrigerant (B)) stored in the accumulator tank 110 upstream of the evaporator 40 is increased to decrease a concentration of the lower pressure refrigerant (e.g., second refrigerant (B)) in the climate control system 100 and thus to increase system capacity. In a second operating scenario, an amount of refrigerant (e.g., second refrigerant (A)) stored in the accumulator tank 110 upstream of the evaporator 40 is decreased to increase a concentration of the lower pressure refrigerant (e.g., second refrigerant (B)) in the climate control system 100 and thus to decrease system capacity. As will be appreciated by those of skill in the art, conventional components used with the accumulator 110 tank or other aspects of the climate control system 100 are not shown, including flow rate, temperature, and pressure monitors, actuators, valves, controllers, dryers, conventional accumulators, and the like.

Where it is desired to isolate an indoor portion 102 of the climate control system 100 from the outdoor portion 104, an optional isolation or actuated valve 118 may be disposed in fluid conduit 120, for example, disposed prior to the expansion valve 70. The valve 118 provides the ability to isolate the outdoor side 104 of the climate control system 100 from the indoor side 102. The valve 118 may be a sealing ball valve, solenoid valve, electronic expansion valve, check valve, needle valve, butterfly valve, globe valve, vertical slide valve, choke valve, knife valve, pinch valve, plug valve, gate valve, diaphragm valve, or another suitable type of actuated valve.

The working fluid exiting the evaporator 40 at point 130 then enters a third heat exchanger that may be a liquid-to-suction heat exchanger 122. An optional check valve 128 may be disposed between an exit of the evaporator 40 and the liquid-to-suction heat exchanger 122 to prevent backflow into the evaporator 40.

Generally, the liquid-to-suction heat exchanger 122 transfers heat between the relatively hot condensate liquid exiting the condenser and the colder biphasic fluid exiting the evaporator. More specifically, the hotter condensate liquid can increase the temperature and vapor quality from the evaporator in a suction heat exchanger to provide a higher level of sub-cooling of the condensate effluent to increase the evaporator capacity. Thus, the liquid-to-suction heat exchanger 122 can provide certain advantages in the climate control system 100, including further cooling the liquid refrigerant prior to it entering expansion valve 70, which can increase system efficiency, can reduce possible flashing in the liquid line and enable the expansion valve to operate with greater stability. In this manner, the partially evaporated refrigerant is further evaporated by heat transfer with slightly warmer partially condensed (or performs subcooling of) refrigerant from the same cycle. Further, the suction to liquid-to-suction heat exchanger 122 does not superheat the suction gas in certain variations.

A first side 124 of the liquid-to-suction heat exchanger 122 receives the multiphase working fluid exiting evaporator 40. Notably, any of the design configurations described above in the context of evaporators or condensers for countercurrent heat exchange are suitable for use as the liquid-to-suction heat exchanger 122. A second side 126 of the liquid-to-suction heat exchanger 122 in heat exchange relationship with the first side 124 receives working fluid exiting the condenser 62 at point 138 that may thus comprise both first refrigerant (A) and second refrigerant (B) that are partially or fully in liquid phase. Thus, the condensed working fluid at point 138 passes on the second side 126 and transfers heat to the partially evaporated stream 130 leaving the evaporator 40 on the first side 124 of liquid-to-suction heat exchanger 122. An optional check valve 128 may be disposed between an exit of the evaporator 40 and the first side 124 of the liquid-to-suction heat exchanger 122 to prevent backflow into the evaporator 40. After passing through the first side 124 of the liquid-to-suction heat exchanger 122, the multiphase working fluid passes into flash tank 42, where it is separated into first vapor stream 132 and second liquid stream 134. After passing through the second side 126, the working fluid condensate continues through fluid conduit 120 to expansion valve 70. In certain aspects, a balance of refrigerant charge in the system can be modified by operating with less subcooling at the outlet on the second side 126 of the liquid-to-suction heat exchanger 122.

In certain aspects, an amount of heat transferred by the liquid-to-suction heat exchanger 122 is expressed by a difference in temperature ($\Delta T$) between a first temperature ($T_1$) of the working fluid at point 138 and a second temperature ($T_2$) of the working fluid at point 130. Much like the liquid-to-suction heat exchanger 222 in FIG. 4, a difference between the first temperature ($T_1$) at point 138 and the second temperature ($T_2$) at point 130 may be greater than or equal to about 5° C. (where the second temperature $T_2$ is at least about 5° C. below the first temperature $T_1$), optionally greater than or equal to about 10° C., optionally greater than or equal to about 15° C., optionally greater than or equal to about 20° C., optionally greater than or equal to about 30° C., optionally greater than or equal to about 40° C., optionally greater than or equal to about 50° C., optionally greater than or equal to about 60° C., optionally greater than or equal to about 70° C., optionally greater than or equal to about 80° C., optionally greater than or equal to about 90° C., and in certain variations, optionally greater than or equal to about 100° C.

In one non-limiting example of operation of a climate control system 100, a discharge temperature at the compressor 50 at point 136 may be 157° F. As the vapor enters the condenser inlet 60 and blends with liquid stream 134, a temperature at point 170 may be 110° F. The condenser 62 may be operated to reduce temperature of the working fluid down to about 95° F. After passing through the flash tank 42 and the liquid-to-suction heat exchanger 122, a temperature at point 174 in the evaporator 40 may be about 47° F. At point 176, the working fluid may have a temperature of about 75° F. A temperature increase within the evaporator 40 is about 29° F. In this scenario, a temperature of the stream entering the second side of the liquid-to-suction heat exchanger 122 is about 95° F., while the stream entering the first side of the liquid-to-suction heat exchanger 122 is about 75° F., where the stream exiting the second side is about 25° F., which amounts to a temperature reduction of about 20° F. after passing through the liquid-to-suction heat exchanger 122.

In certain aspects, the gas-liquid separation vessel or flash tank 42 that is downstream of the evaporator 40 may have excess capacity for storage of additional refrigerant or may be associated with an ancillary storage tank. In certain aspects, a residence time of the refrigerant in the flash tank 42 may be greater than or equal to about 30 seconds to less than or equal to about 10 minutes. In this manner, the flash tank 42 can also store refrigerant to balance the refrigerant in the climate control system 100, for example, to allow more or less subcooling in the condenser 62 and/or second side 126 of the liquid-to-suction heat exchanger 122.

The climate control system 100 also has another optional design feature associated with the condenser 62 to provide additional capacity modulation. As shown, the compressor 50 generates a high-pressure vapor stream 136. The high-pressure vapor stream may pass through a flow control valve (e.g., a three way valve 150), where a portion of the high-pressure vapor stream (predominantly containing the more volatile high-pressure first refrigerant (A)) can optionally be diverted into an accumulator or other refrigerant storage device, such as storage tank 160, that enables modulation of the system capacity during operational transitions. The portion of the stream that is stored in the storage tank 160 is desirably transformed to a liquid, which may occur by passing the diverted stream through the condenser 62. All or a portion of the remaining high-pressure vapor stream 136 can also be directed to enter the condenser via condenser inlet 60. When release of stored liquid refrigerant from the storage tank 160 is necessary, it may be routed through a second flow control device (e.g., a three-way valve 162) where it joins the condensed working fluid exiting the condenser 62 to form stream 138 directed to the optional liquid-to-suction heat exchanger 122 and ultimately the expansion valve 70. In this manner, the storage tank 160 (upstream of the expansion valve 70 and evaporator 40) is configured in parallel with condenser 62 and that receives only compressor discharge vapor from stream 136, where there can be liquid in the system 100 with the highest single component concentration, which would be a higher concentration of the higher-pressure refrigerant (first refrigerant (A)). Thus, where the amount of refrigerant (e.g., first refrigerant (A)) stored in the storage tank 160 downstream of the parallel condenser 62 is increased, a concentration of the higher-pressure refrigerant (first refrigerant (A)) in the system 100 is decreased, which decreases cooling capacity. On the other hand, where the amount of refrigerant (e.g., first refrigerant (A)) stored in the storage tank 160 downstream of the parallel condenser 62 is decreased, a concentration of the higher-pressure refrigerant (first refrigerant (A)) in the system 100 is increased, which increases cooling capacity.

In other aspects, a cooling capacity of the climate control system may be modulated by a combination of using stepped compression and modifying refrigerant concentration or alternatively, using variable speed compression and refrigerant concentration, or alternatively, cycling off individual compressors in a system having multiple compressors and modifying refrigerant concentration to achieve lower capacity turn down or continuous capacity control.

In yet another aspect, where another fluid is included in the system (such as an oil in the working fluid), that fluid may be preferentially soluble with a single component of the refrigerant blend (e.g., either with first refrigerant (A) or second refrigerant (B)) in order to store a concentrated amount of a single component (e.g., either high-pressure first refrigerant (A) or low-pressure second refrigerant (B)) in an oil sump (150 and/or 150') or tank in part of the system 100 of FIG. 5 or system 200 of FIG. 4. Thus, above a given pressure and temperature, the oil may reach a solubility limit for one of the first refrigerant or the second refrigerant, such that only one of the refrigerants remains soluble in the oil, while the other is not and no longer circulates in the working fluid.

FIG. 6 shows another embodiment of a climate control system in the form of a heat pump system 300. The portions of the heat pump system 300 located indoors 302 or in confined spaces are delineated by a dotted line, while the remaining portions of the heat pump system 300 are located outdoors 304. A first heat exchanger 310 is disposed indoors and may be operated as a condenser in a first operational mode or heating mode or an evaporator in a second operational mode or cooling mode. The first heat exchanger 310 is commonly referred to as an air handling unit that provides a supply side and a return side for processing air for an indoor environment. The first heat exchanger 310 may include a fan 312 and a coil 314. Depending on the operational mode, the supply air that is passed over the coil 314 (shown by the arrows in a countercurrent direction, although concurrent flow may also occur) may be either heated or cooled.

The heat pump system 300 also includes a second heat exchanger 320 disposed outdoors 304 that likewise includes a fan 322 and a coil 324. The second heat exchanger 320 is commonly referred to as an outdoor unit and circulates ambient air across the coil 324 and generates exhaust. Depending on the operational mode, the ambient air that is passed over the coil 324 (shown by the arrows in a countercurrent direction, although concurrent flow may also occur) may be cooled or heated. The second heat exchanger 320 may be operated as an evaporator in the first operational mode or heating mode or a condenser in the second operational mode or cooling mode. The heat pump system 300 will be described herein in the first operational mode where the first heat exchanger 310 operates a condenser to heat supply air indoors, while the second heat exchanger 320 operates as an evaporator. As will be appreciated by those of skill in the art, the concepts discussed herein are equally applicable to operation in the second operational mode, as well.

The heat pump system 300 circulates the working fluid with two refrigerants having high glide or a difference in boiling points between the first refrigerant (A) and the second refrigerant (B) of greater than or equal to about 25° F. at atmospheric pressure, by way of example. In one example, where a first refrigerant (A) may be carbon dioxide ($CO_2$) while a second refrigerant (B) may be R1233zd. The initial refrigerant blend introduced into the heat pump system 300 may have approximately 93% by wt. $CO_2$ and 7% by wt. of R1233zd. Like the previously described embodiments, the working fluid may also include oil(s) at certain points in the system. The heat pump system 300 has a fluid flow path or fluid conduit 332 that establishes fluid communication between the various components, so that the working fluid may circulate in a loop as discussed further herein.

First, the working fluid including the first refrigerant (A) and second refrigerant (B) may enter the enter the first heat exchanger 310 in the form of the condenser, which causes at least a portion of first refrigerant (A) and/or second refrigerant (B) to transform from a gas or vapor phase (or multiphasic fluid) to a liquid phase (to reduce the vapor quality of the stream as it exits the first heat exchanger 310. The condensing is exothermic and thus releases heat to the supply air passing over coil 314. In one non-limiting example, air entering the first heat exchanger 310 may have a temperature of about 72° F. and air exiting the first heat exchanger 310 may have a temperature of about 93° F. The working fluid entering the first heat exchanger 310 at point 316 may be about 98° F., while the working fluid exiting the first heat exchanger 310 at point 318 may be about 83° F. In one example, where the refrigerant comprises $CO_2$ and R1233zd, as the working fluid exits the first heat exchanger 310 near point 318, it has approximately 86% $CO_2$. Next, the working fluid passes through a first dual four-way valve 330 (that can reverse the flow of refrigerant in the fluid conduit 330), where the working fluid continues in the first operational mode to a third heat exchanger or liquid-to-suction heat exchanger 340. The first dual four-way valve may be paired with a second dual four-way valve 334 discussed further below that can maintain the working fluid in counterflow to air in both heating and cooling operational modes. As will be appreciated by those of skill in the art, the heat pump system may instead have one or more reversing valves to direct working fluid flow in a different direction in the system. As with other embodiments, the liquid-to-suction heat exchanger 340 transfers heat between the relatively hot condensate liquid exiting the condenser (in the first operational mode, this is the first heat exchanger 310) and cold vapor exiting the evaporator (in the first operational mode, this is the second heat exchanger 320). The working fluid passes through a first side 342 of the liquid-to-suction heat exchanger 340 that is in heat exchange relationship with a second side 344.

Next, the working fluid passes into an expansion valve 346 where pressure of the working fluid is reduced. The working fluid then passes through the second dual four-way valve 334. In the first operational mode, the working fluid thus passes into the second heat exchanger 320 inlet serving as an evaporator in the first operational mode, which is circulated therethrough to transform from a liquid phase (or low quality vapor phase) at point 326 to a gas or vapor phase at point 328 as it exits the evaporator, where the cooling effect of endothermic energy absorption occurs. Air flowing through the second heat exchanger 320/evaporator is shown by arrows, which is cooled. Notably ambient air may enter the second heat exchanger 320 in one non-limiting example at about 35° F. and exit after passing over the coil 324 at about 20° F. Meanwhile, the working fluid circulating in the coil 324 at point 326 may be about 17° F. and about 32° F. at about Point 238. The amount of $CO_2$ in the working fluid may be about 86%.

Next, the working fluid passes through an opposite side of the first dual four-way valve 330 and is directed to the second side 344 of the liquid-to-suction heat exchanger 340 for heat transfer. After passing through the liquid-to-suction heat exchanger 340, the working fluid may exit at a higher temperature, in this non-limiting example, at about 73° F.

Next, the working fluid passes a gas-liquid/liquid-vapor separating vessel or flash tank 350. Prior to entering the flash tank 350, the working fluid may be a multiphase composition that comprises a combination of both first refrigerant (A) (e.g., $CO_2$) and second refrigerant (B) (e.g., R1233zd) that are partially or fully in gas phase. As noted above, one aspect of the present technology is that the working fluid having the refrigerant blend with first refrigerant (A) and second refrigerant (B) is only partially evaporated to form a mixture of both gas/vapor and liquid. The presence of the gas-liquid separator (e.g., flash tank 350) in the heat pump system 300 provides an ability to control how much of a temperature range for the refrigerant blend is being used. By way of example, the vapor quality, or mass fraction of vapor of the working fluid at point 328 that exits the second heat exchanger 320 serving as an evaporator may be predetermined to be any amount, for example from greater than or equal to about 15% to about 100% vapor quality, by way of non-limiting example, depending on an amount of liquid evaporated. In certain aspects, like in the embodiments described above, the flash tank 350 may have excess capacity for storage of additional refrigerant or may be associated with an ancillary storage tank. Thus, the flash tank 350 may store a fractionated blend of the working fluid. Prior to entering the flash tank 350, in one non-limiting example, an amount of $CO_2$ in the working fluid may be about 86%.

After the working fluid passes into a gas-liquid separation vessel or flash tank 350 that receives the working fluid and generates a vapor stream 352 and a liquid stream 354, like those discussed previously above. The vapor stream 352 may have about 98% of $CO_2$. The vapor stream 352 passes into a compressor 360 where it is compressed to increase pressure and form a high-pressure vapor or gas stream 356 exiting the compressor 360. The high-pressure gas stream 356 exiting the compressor 360 has a pressure that is significantly greater than the pressure of vapor stream 352. Further, the high-pressure gas stream 356 may have about 98% of $CO_2$.

The liquid stream 354 from the flash tank 350 may have about 76% $CO_2$. The liquid stream 354 from the flash tank 350 passes into pump 362, where a pressure of the liquid stream 358 in increased. After passing through the pump 362, the high-pressure liquid stream 358 is then combined with the high-pressure gas stream 356 at valve 364 directed towards an inlet of the first heat exchanger/condenser 310. The concentration of first refrigerant (A) and second refrigerant (B) may be varied by injecting and combining different amounts of stored low-pressure refrigerant (refrigerant (B) here R1233zd) in the high-pressure liquid stream 358 with the high-pressure gas stream 356.

The first heat exchanger 310 is thus disposed downstream of the compressor 360 and pump 362 and thus receives and cools the pressurized stream 356 and receives high-pressure liquid stream 358 to generate a condensing multiphase working fluid stream 318. Thus, the stream that enters the inlet of the first heat exchanger/condenser 310 is a blended stream of high-pressure vapor and liquid. By way of example, the vapor quality, or mass fraction of vapor of the working fluid that enters the first heat exchanger/condenser 310 may be predetermined to be an amount ranging from at greater than or equal to about 10% vapor quality to less than or equal to about 90% vapor quality, such as 30% vapor quality, optionally 40% vapor quality, and the like, by way of non-limiting example, depending on an amount of liquid pumped from the flash tank 350 through pump 362 and blended with the vaporized pressurized stream 356.

As will be appreciated by those of skill in the art, in a second operational mode, the flow of the working fluid is modified (e.g., reversed) in parts of the fluid conduit 332 so that the first heat exchanger 310 instead operates as an evaporator and the second heat exchanger 320 operates as a condenser. Thus, for example, after the working fluid is separated in the flash tank 350 and either passes into the compressor 360 to form the high-pressure stream 356 or the high-pressure liquid stream 358, where the combined streams may be directed to the inlet of the second heat exchanger 320. The working fluid may then be flow and be processed in a similar manner to that previously described just above or in the context of FIG. 4. Further, other features described above in earlier variations may be incorporated into the heat pump system 300.

Those of skill in the art will also appreciate that conventional components used with the heat pump system 300 may not be shown, including flow rate, temperature, and pressure monitors, actuators, valves, controllers and the like.

In various aspects, control of the climate control systems, including heat pump systems, described in any of the embodiments above may be achieved by a control module. In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

In various aspects, the control module can be used to activate, deactivate, or modulate operation of various components and devices in the climate control system, including compressor(s), fan(s), pump(s), valve(s), and the like. The control module may receive input from various sensors in the climate control system, such as temperature sensors, pressure sensors, flow rate sensors, current and voltage meters, etc. The sensors provide measurements from which a control module can determine necessary modifications to the climate control system.

The control module can include one or more modules and can be implemented as part of a control board, furnace board, thermostat, air handler board, contactor, or other form of control system or diagnostic system. The control module can contain power conditioning circuitry to supply power to various components using 24 Volts (V) alternating current (AC), 120V to 240V AC, 5V direct current (DC) power, etc. The control module can include bidirectional communication which can be wired, wireless, or both whereby system debugging, programming, updating, monitoring, parameter value/state transmission etc. can occur. Climate control systems can more generally be referred to as air conditioning or refrigeration systems.

Thus, a control module may open, close, regulate, or direct working fluid flow (or portions of working fluid flow, such as first refrigerant and/or second refrigerant) into and out of various components and devices in the system via the conduits, including in the evaporator, condenser, expansion valve, gas-liquid separator, heat exchangers, storage vessels, and the like.

In certain aspects, the present disclosure provides methods for operating a climate control system that circulates a working fluid comprising a refrigerant blend having high glide. Such methods may modulate cooling capacity of the climate control systems as described above, by taking advantage of the high glide properties or fractionation behavior of the refrigerant blend selected. The methods may comprise circulating a working fluid in any of the climate control systems described above. For example, the working fluid may be circulated through a fluid conduit that comprises a compressor for pressurizing the working fluid, a condenser disposed downstream of the compressor for condensing at least a portion of the working fluid, an expansion valve disposed downstream of the condenser to reduce a pressure of the working fluid, an evaporator disposed downstream of the expansion valve and upstream of the compressor for evaporating at least a portion of the working fluid, and a gas-liquid separation vessel disposed downstream of the evaporator that receives the working fluid and separates it into a vapor stream that is directed to the compressor and a liquid stream that is directed through a pump to the condenser. As described previously above, the working fluid comprises a refrigerant blend having high glide that comprises a first refrigerant and a second refrigerant, where a difference in boiling points between the first refrigerant and the second refrigerant is at least greater than or equal to about 25° F. at atmospheric pressure.

In one aspect, the present disclosure provides a method of operating a climate control system that circulates a working fluid comprising a refrigerant blend having high glide. The method includes pressurizing a working fluid by passing it through a compressor in a fluid conduit. The method also includes condensing at least a portion of the working fluid in a first heat exchanger disposed downstream of the compressor. Reducing pressure of the working fluid occurs by it passing through an expansion device disposed downstream of the first heat exchanger. At least a portion of the working fluid is evaporated in a second heat exchanger disposed downstream of the expansion valve and upstream of the compressor. The method also includes passing the working fluid into a gas-liquid separation vessel disposed downstream of the second heat exchanger that separates the working fluid into a vapor stream that is directed to the compressor and a liquid stream that is directed to the first heat exchanger. The working fluid comprises the refrigerant blend having high glide that comprises a first refrigerant and a second refrigerant. A difference in boiling points between the first refrigerant and the second refrigerant is greater than or equal to about 25° F. at atmospheric pressure.

In one aspect, the high glide refrigerant blend defines a full phase change for condensation (as described above in the context of FIG. 3A) and the condensing only partially condenses the working fluid to a liquid phase and permits only a portion of the full phase change to occur. In this manner, after the condensing, a greater portion or percentage of the second refrigerant is liquid, while a greater portion or percentage of the first refrigerant remains as vapor and a lesser portion of the first refrigerant is liquid as it enters the expansion device and the evaporator. In another aspect, the high glide refrigerant blend defines a full phase change for evaporation (as described above in the context of FIG. 3B) and the evaporating only partially evaporates the working fluid to a vapor phase and permits only a portion of the full phase change to occur. In this manner, after the evaporating, a greater portion or amount of the first refrigerant is vapor, while a lesser portion of the second refrigerant is vapor and a greater portion of the second refrigerant remains as liquid as it enters the gas-liquid separation vessel.

In certain variations, the condensing only partially condenses the working fluid to a liquid phase and the evaporating only partially evaporates the working fluid to a vapor phase. Thus, in a first variation, (i) the condensing may be performed on a mixed stream formed by mixing the liquid stream pumped from the gas-liquid separation vessel and working fluid exiting the compressor that is pressurized and superheated to condense the mixed stream from a two-phase fluid to a two-phase fluid with relatively lower vapor quality. Alternatively, in a second variation, (ii) the condensing is performed on a mixed stream formed by mixing the liquid stream pumped from the gas-liquid separation vessel and working fluid exiting the compressor that is pressurized and superheated to condense the mixed stream from a two-phase fluid to a saturated or subcooled liquid. The evaporating is performed on a fluid stream having a first vapor quality that is higher than a second vapor quality.

In other aspects, the fluid conduit further comprises at least one storage vessel, so that the method comprises further comprising storing a portion of the first refrigerant and/or second refrigerant in the at least one storage vessel to modulate cooling capacity of the system.

In one variation, the at least one storage vessel is disposed upstream of the evaporator in the fluid conduit (such as accumulator 110 shown in FIG. 5 and described above). Thus, the method may include increasing an amount of the second refrigerant stored in the at least one storage vessel to decrease a concentration of the second refrigerant in the working fluid circulating in the fluid conduit, which increases cooling capacity of the climate control system. In another variation, decreasing an amount of the second refrigerant stored in the at least one storage vessel increases a concentration of the second refrigerant in the working fluid circulating in the fluid conduit, which serves to decrease cooling capacity of the climate control system.

In another aspect, the at least one storage vessel is disposed in the fluid conduit in parallel with the condenser (such as storage tank 160 shown in FIG. 5 and described above). The method may include increasing an amount of first refrigerant stored in the at least one storage vessel to decrease a concentration of the first refrigerant in the working fluid circulating in the fluid conduit and to decrease cooling capacity of the climate control system. In another variation, the method may include decreasing an amount of the first refrigerant stored in the at least one storage vessel to increase a concentration of the first refrigerant in the working fluid circulating in the fluid conduit and to increase cooling capacity of the climate control system.

In certain other aspects, the storage vessel may be the gas-liquid separation vessel (such as flash tank 42 in FIGS. 1, 5, and 6) that is downstream of the evaporator, which as described above, may have excess capacity for storage of additional refrigerant or may be associated with an ancillary storage tank. In this manner, the method may include storing one or more of the first refrigerant or the second refrigerant in the gas-liquid separation vessel to balance the refrigerant in the climate control system. For example, the method may include raising a downstream level of one or both of the first refrigerant and/or second refrigerant to counter the effects of a lower upstream level of first refrigerant and/or second refrigerant.

The methods may further comprise circulating air through the evaporator and condenser in a heat transfer relationship with the fluid conduit to transfer heat to the working fluid (e.g., prior to entering the evaporator). In certain aspects, a first temperature range of the refrigerant blend is operated to be greater than or equal to about 50% to less than or equal to about 200%, optionally greater than or equal to about 66% to less than or equal to about 150% of a second temperature range of the air.

In yet other aspects, the fluid conduit further comprises a heat exchanger disposed downstream of a first circuit including a first heat exchanger (e.g., the condenser) and upstream of a second circuit including a second heat exchanger (e.g., evaporator), such as liquid-to-suction heat exchanger 122 shown in FIGS. 4-6 and described above. The method further comprises passing the multiphase working fluid stream from the condenser through a first side of liquid-to-suction heat exchanger in a first flow direction and passing the low-pressure multiphase working fluid stream from the evaporator in a second flow direction to transfer heat therebetween. In certain aspects, the method may include modifying the balance of charge in the system by operating with less subcooling at the outlet of the suction to liquid-to-suction heat exchanger.

In other aspects, a cooling capacity of the climate control system may be modulated by employing compressors that achieve stepped compression, for example, a combination of using stepped compression and modifying refrigerant concentration. In another variation, variable speed compression and refrigerant concentration can be used to modulate system capacity. In yet another variation, a system that has multiple compressors in the fluid conduit may be individually cycled off and modifying refrigerant concentration to achieve lower capacity turn down or continuous capacity control.

In yet another aspect, where another fluid is included in the system (such as an oil in the working fluid), that fluid may be preferentially soluble with a single component of the refrigerant blend (e.g., either with first refrigerant or second refrigerant) in order to store a concentrated amount of a single component (e.g., either high-pressure first refrigerant or low-pressure second refrigerant) in an oil storage vessel or select regions in part of the system In certain other aspects, a refrigerant blend may include a first refrigerant that is an A1 refrigerant such as $CO_2$ mixed with a second refrigerant that is a flammable refrigerant (such as an ASHRAE 34 class A3), like dimethyl ether. In this variation, the system maintains a ratio of the relatively inert first refrigerant (e.g., A1 refrigerant) to limit an amount of the second flammable refrigerant on the indoor side of the system to a safe level. Further, the climate control system could have an indoor portion and an outdoor portion that may be isolated from one another, such as is described in co-owned U.S. patent application Ser. No. 17/019,946 filed Sep. 14, 2020, entitled Refrigerant Isolation Using a Reversing Valve, the relevant portions of which are incorporated by reference. In other aspects, the present disclosure may contemplate a method of calculating an amount of the second flammable refrigerant component of a binary mixture of the first and second refrigerant on the indoors, for example, as described in co-owned U.S. patent application Ser. No. 16/940,843 filed on Jul. 28, 2020 and entitled "Refrigerant Leak Detection," the relevant portions of which are incorporated by reference, where charge can be calculated by using the proportional relationship between enthalpy and specific volume of a refrigerants, but employs more than the four described measurements.

Further, the cycle could allow some limited variation in refrigerant concentration by allowing storage in a section of the system or could maintain the same concentrations through all conditions to maintain the same safe level of flammable refrigerant from the baseline operating condition.

Certain embodiments of the inventive technology can be further understood by the specific example contained herein. Specific Examples are provided for illustrative purposes of how to make and use the devices and methods according to the present teachings and, unless explicitly stated otherwise, are not intended to be a representation that given embodiments of this invention have, or have not, been made or tested.

EXAMPLE

A non-limiting simulated operation example is provided herein at Table 1 to illustrate certain concepts of the present disclosure. A single refrigerant blend includes carbon dioxide (R744, the low boiling point, high-pressure first refrigerant) and an HFO R1233zd (the high boiling point, low-pressure second refrigerant). As will be appreciated, this refrigerant blend is merely a non-limiting example of a single refrigerant blend; however, additional blends may be used and tailored to certain desired performance requirements. The evaporator inlet and outlet both have two-phase streams and represent only a small portion of the temperature range in phase change.

One measure of system performance is an energy efficiency ratio (EER) gain or loss or a coefficient of performance (COP). COP is generally defined as the heating capacity of the system divided by the power input to the system and can be a useful measure of the compressor's performance. In various aspects, the performance of a compressor has a COP loss defined by $$\Delta COP\ (\%) = \frac{(COP_{initial} - COP_{final})}{COP_{initial}} \times 100,$$

where $COP_{initial}$ is an initial COP measured at the beginning of compressor operation and $COP_{final}$ is compressor performance at the end of a reliability test.

TABLE 1

| Operating Condition Scenario | Concentration Through Heat Exchanger (Evaporator) | Cooling Capacity (BTU/hr.) | Evaporator Inlet Temperature (° F.) | Evaporator Outlet Temperature (° F.) | EER/COP† |
|---|---|---|---|---|---|
| Design Air Conditioning | 93.5% $CO_2$ 6.5% R1233zd | 24,000 | 56.6 | 76.5 | 13 EER |
| Seasonal Air Conditioning (1) | 90.0% $CO_2$ 10.0% R1233zd | 18,000 | 56.6 | 71.9 | 19 EER |
| Seasonal Air Conditioning (2) | 72.0% $CO_2$ 28.0% R1233zd | 18,000 | 56.6 | 71.9 | 16 EER |
| Medium Temperature Refrigeration | 90.0% $CO_2$ 10.0% R1233zd | 10,500 | 27.5 | 38.1 | 1.5 COP |
| 20° F. Low Temperature Refrigeration | 85.0% $CO_2$ 15.0% R1233zd | 5,000 | −4.9 | 16.3 | 0.8 COP |
| 10° F. Low Temperature Refrigeration | 75.0% $CO_2$ 25.0% R1233zd | 2,000 | −20 | 5.3 | 0.45 COP |

†Energy efficiency ratio (EER)/ coefficient of performance (COP).

Table 1 shows competitive or better performance at AC and medium temperature reference conditions and potential for competitive performance with a different blend at low temperature references.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate control system that circulates a working fluid comprising a refrigerant blend having high glide, the climate control system comprising:

the working fluid comprising a first refrigerant and a second refrigerant, wherein a difference in boiling points between the first refrigerant and the second refrigerant is greater than or equal to about 25° F. at atmospheric pressure;

a gas-liquid separation vessel that receives the working fluid and generates a vapor stream and a liquid stream;

a compressor that receives the vapor stream from the gas-liquid separation vessel and generates a pressurized vapor stream;

a liquid pump that receives the liquid stream from the gas-liquid separation vessel and generates a pressurized liquid stream;

a first heat exchanger disposed downstream of the compressor that receives and cools the pressurized vapor stream directly from the compressor and the pressurized liquid stream directly from the liquid pump to generate a multiphase or liquid working fluid stream by heat exchange with air;

a second heat exchanger that receives the multiphase or liquid working fluid stream and at least partially vaporizes the multiphase or liquid working fluid that is directed to the gas-liquid separation vessel by heat exchange with air;

an expansion device disposed between the first heat exchanger and the second heat exchanger that expands the multiphase or liquid working fluid stream; and a fluid conduit for circulating the working fluid and establishing fluid communication between the second heat exchanger, the gas-liquid separation vessel, the compressor, the first heat exchanger, and the expansion device through which the working fluid circulates.

2. The climate control system of claim 1, further comprising a liquid-to-suction heat exchanger disposed downstream of the first heat exchanger and upstream of the second heat exchanger, wherein the liquid-to-suction heat exchanger receives the multiphase or liquid working fluid stream from the first heat exchanger in a first flow direction and a low-pressure multiphase working fluid stream from the second heat exchanger in a second flow direction to transfer heat therebetween.

3. The climate control system of claim 2, further comprising a check valve disposed between the second heat exchanger and the liquid-to-suction heat exchanger.

4. The climate control system of claim 1, further comprising an accumulator for storing a volume of the working fluid disposed downstream of the expansion device and upstream of the second heat exchanger.

5. The climate control system of claim 1, further comprising a storage vessel for the working fluid disposed in parallel in the fluid conduit to the first heat exchanger that is configured to selectively receive a portion of the pressurized vapor stream from the compressor and that is configured to be in selective fluid communication with the expansion device.

6. The climate control system of claim 1, wherein the gas-liquid separation vessel has a volume configured to selectively store at least a portion of the working fluid.

7. The climate control system of claim 1, wherein the first refrigerant is selected from the group consisting of: difluoromethane (R-32), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro,monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), isomers, and combinations thereof.

8. The climate control system of claim 1, wherein the first refrigerant and the second refrigerant are selected from the group consisting of: carbon dioxide (R-744), chlorodifluoromethane (R-22), 1,1,1,2-tetrafluoroethane (R134A), R410A (a near-azeotropic mixture of difluoromethane (R-32) and pentafluoroethane (R-125)), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro,monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), isomers and combinations thereof.

9. The climate control system of claim 1, wherein the working fluid further comprises a lubricant that has a greater solubility with the first refrigerant as compared to the second refrigerant and the climate control system further comprises an oil storage vessel or sump that stores at least a portion of the lubricant in the working fluid.

10. The climate control system of claim 1, further comprising a reversing valve or a pair of four way valves to enable the system to conduct both heating and cooling.

11. A method for operating a climate control system that circulates a working fluid comprising a refrigerant blend having high glide, the method comprising:

pressurizing a working fluid vapor by passing it through a compressor in a fluid conduit;

pressurizing the working fluid liquid by passing it through a pump;

condensing at least a portion of the working fluid in a first heat exchanger disposed downstream of the compressor where heat is exchanged with passing air in the first heat exchanger, wherein the working fluid vapor is received directly from the compressor into the first heat exchanger and the working fluid liquid is received directly from the pump into the first heat exchanger;

reducing pressure of the working fluid by passing through an expansion device disposed downstream of the first heat exchanger;

evaporating at least a portion of the working fluid in a second heat exchanger disposed downstream of the expansion valve and upstream of the compressor, where heat is exchanged with passing air in the second heat exchanger; and passing the working fluid into a gas-liquid separation vessel disposed downstream of the second heat exchanger that separates the working fluid into the working fluid vapor that is directed to the compressor and the working fluid liquid that is directed to the pump and the first heat exchanger, wherein the working fluid comprises the refrigerant blend having high glide that comprises a first refrigerant and a second refrigerant, wherein a difference in boiling points between the first refrigerant and the second refrigerant is greater than or equal to about 25° F. at atmospheric pressure.

12. The method of claim 11, wherein the high glide refrigerant blend defines a full phase change for condensation and the condensing only partially condenses the working fluid to a liquid phase and permits only a portion of the full phase change to occur, so that after the condensing, the second refrigerant is predominantly liquid, while a portion of the first refrigerant is liquid and a portion of the first refrigerant remains as vapor entering the expansion device and the second heat exchanger.

13. The method of claim 11, wherein the high glide refrigerant blend defines a full phase change for evaporation and the evaporating only partially evaporates the working fluid to a vapor phase and permits only a portion of the full phase change to occur, so that after the evaporating, the first refrigerant is vapor, while a portion of the second refrigerant is vapor and a portion of the second refrigerant remains as liquid entering the gas-liquid separation vessel.

14. The method of claim 11, wherein the condensing only partially condenses the working fluid to a liquid phase and the evaporating only partially evaporates the working fluid to a vapor phase, wherein:

(i) the condensing is performed on a mixed stream formed by mixing the liquid stream pumped from the gas-liquid separation vessel and working fluid exiting the compressor that is pressurized and superheated to condense the mixed stream from a two-phase fluid having a first vapor quality to a two-phase fluid having a second vapor quality lower than the first vapor quality; or (ii) the condensing is performed on a mixed stream formed by mixing the liquid stream pumped from the gas-liquid separation vessel and working fluid exiting the compressor that is pressurized and superheated to condense the mixed stream from a two-phase fluid to a saturated or subcooled liquid and the evaporating is performed on a fluid stream having a third vapor quality that is higher than a fourth vapor quality.

15. The method of claim 11, wherein the fluid conduit further comprises at least one storage vessel and the method comprises further comprising storing a portion of the first refrigerant and/or the second refrigerant in the at least one storage vessel to modulate cooling capacity of the climate control system.

16. The method of claim 15, wherein the at least one storage vessel is disposed upstream of the second heat exchanger in the fluid conduit, wherein increasing an amount of the second refrigerant stored in the at least one storage vessel decreases a concentration of the second refrigerant in the working fluid circulating in the fluid conduit and increases cooling capacity of the climate control system; or decreasing an amount of the second refrigerant stored in the at least one storage vessel increases a concentration of the second refrigerant in the working fluid circulating in the fluid conduit and decreases cooling capacity of the climate control system.

17. The method of claim 15, wherein the at least one storage vessel is disposed in the fluid conduit in parallel with the first heat exchanger, where the method includes increasing an amount of first refrigerant stored in the at least one storage vessel to decrease a concentration of the first refrigerant in the working fluid circulating in the fluid conduit and to decrease cooling capacity of the climate control system; or decreasing an amount of the first refrigerant stored in the at least one storage vessel to increase a concentration of the first refrigerant in the working fluid circulating in the fluid conduit and to increase cooling capacity of the climate control system.

18. The method of claim 11, wherein a first temperature range of the refrigerant blend is operated to be greater than or equal to about 66% to less than or equal to about 150% of a second temperature range of air in the first heat exchanger or the second heat exchanger.

19. The method of claim 11, wherein the fluid conduit further comprises a liquid-to-suction heat exchanger disposed downstream of the first heat exchanger and upstream of the second heat exchanger, wherein the method further comprises passing the working fluid stream from the first heat exchanger through a first side of liquid-to-suction heat exchanger in a first flow direction and passing the low-pressure working fluid stream from the second heat exchanger in a second flow direction to transfer heat therebetween.

20. The method of claim 11, wherein the first refrigerant and the second refrigerant are selected from the group consisting of: carbon dioxide (R-744), chlorodifluoromethane (R-22), 1,1,1,2-tetrafluoroethane (R134A), R410A (a near-azeotropic mixture of difluoromethane (R-32) and pentafluoroethane (R-125)), dimethyl ether (R-E170), propane (R-290), 2,3,3,3,-tetrafluoroprop-1-ene (R-1234yf), cis- and trans-1,3,3,3,-tetrafluoropropene (HFO-1234ye), cis- and trans-1,3,3,3,-tetrafluoroprop-1-ene (R-1234ze), 3,3,3,-trifluoropropene (HFO-1234zf), trifluoro,monochloropropenes (HFO-1233), trans-1-chloro-3,3,3-trifluoropropene (HFO-1233zd(E)), cis-1-chloro-3,3,3-trifluoropropene (HFO-1233zd(Z)), 2-chloro-3,3,3-trifluoropropene (HFO-1233xf), trans-1,1,1,4,4,4-hexafluoro-2-butene (HFO-1336mzz(Z)), cis-1,1,1,4,4,4-hexafluoro-2-butene (HFO-1336mzz(E)), pentafluoropropenes (HFO-1225), 1,1,3,3,3-pentafluoropropene (HFO-1225zc), 1,2,3,3,3-pentafluoropropene (HFO-1225yez), hexafluorobutenes (HFO-1336), cis-1,1,1,4,4,4-hexafluoro-2-butene (HFO-1336mzz(Z)), trans-1,1,1,4,4,4-hexafluoro-2-butene (R1336mzz(E)), trans-1,2-difluoroethene (R-1132(E)), isomers and combinations thereof.

21. A method for operating a climate control system that circulates a working fluid comprising a refrigerant blend having high glide, the method comprising:

pressurizing a working fluid by passing the working fluid through a compressor in a fluid conduit;

pressurizing the working fluid by passing it through a pump;

partially condensing a portion of the working fluid in a first heat exchanger disposed downstream of the compressor to form a multiphasic working fluid, where heat is exchanged with passing air in the first heat exchanger, wherein the portion of working fluid comprises both the working fluid received directly from the compressor into the first heat exchanger and the working fluid received directly from the pump into the heat exchanger;

reducing pressure of the multiphasic working fluid by passing through an expansion valve disposed downstream of the first heat exchanger;

partially evaporating a portion of the multiphasic working fluid in a second heat exchanger disposed downstream of the expansion valve and upstream of the compressor, where heat is exchanged with passing air in the second heat exchanger; and passing the multiphasic working fluid into a gas-liquid separation vessel disposed downstream of the second heat exchanger that separates the working fluid into a vapor stream that is directed to the compressor and a liquid stream that is directed to the first heat exchanger, wherein the working fluid comprises the refrigerant blend having high glide that comprises a first refrigerant and a second refrigerant, wherein a difference in boiling points between the first refrigerant and the second refrigerant is greater than or equal to about 25° F. at atmospheric pressure.

* * * * *